US011841641B2

(12) United States Patent
Yomoda et al.

(10) Patent No.: US 11,841,641 B2
(45) Date of Patent: Dec. 12, 2023

(54) DEVELOPER REPLENISHING CONTAINER AND IMAGE FORMING APPARATUS

(71) Applicant: CANON KABUSHIKI KAISHA, Tokyo (JP)

(72) Inventors: Nobuyuki Yomoda, Kashiwa (JP); Yusuke Yamada, Toride (JP); Ayatomo Okino, Moriya (JP); Manabu Jimba, Toride (JP); Akihito Kamura, Kashiwa (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 17/568,213

(22) Filed: Jan. 4, 2022

(65) Prior Publication Data

US 2022/0128932 A1 Apr. 28, 2022

Related U.S. Application Data

(62) Division of application No. 16/829,011, filed on Mar. 25, 2020, now Pat. No. 11,237,499, which is a (Continued)

(30) Foreign Application Priority Data

Aug. 27, 2015 (JP) ..... 2015-167526

(51) Int. Cl.
*G03G 15/08* (2006.01)

(52) U.S. Cl.
CPC ..... *G03G 15/0877* (2013.01); *G03G 15/087* (2013.01); *G03G 15/0886* (2013.01); *G03G 15/0872* (2013.01)

(58) Field of Classification Search
CPC ..... G03G 15/0886; G03G 15/0877
See application file for complete search history.

(56) References Cited

U.S. PATENT DOCUMENTS 5,113,227 A 5/1992 Miyasaka
5,513,679 A 5/1996 Yamada
(Continued)

FOREIGN PATENT DOCUMENTS

CN 1940764 A 4/2007
CN 101251739 A 8/2008
(Continued)

OTHER PUBLICATIONS

Great Britain Office Action dated Feb. 21, 2017, in related Great Britain Patent Application No. GB1614378.6.
(Continued)

*Primary Examiner* — Sevan A Aydin
(74) *Attorney, Agent, or Firm* — VENABLE LLP

(57) ABSTRACT

Provided is a developer replenishing container including: a developer containing part capable of containing a developer; a discharge port through which the developer contained in the developer containing part is discharged; a conveyance part conveying the developer in the developer containing part by rotating; and a displacement part displaceable in conjunction with rotation of the conveyance part in the developer in a vicinity of the discharge port, and including a moving member capable of reciprocating in conjunction with the rotation of the conveyance part and a biasing member which biases the moving member and which is expandable according to movement of the moving member.

5 Claims, 21 Drawing Sheets

Related U.S. Application Data division of application No. 16/282,489, filed on Feb. 22, 2019, now Pat. No. 10,627,742, which is a division of application No. 15/969,953, filed on May 3, 2018, now abandoned, which is a division of application No. 15/226,141, filed on Aug. 2, 2016, now Pat. No. 9,996,028.

(56) References Cited

U.S. PATENT DOCUMENTS

| | | | |
|---|---|---|---|
| 6,366,755 | B1 | 4/2002 | Takashima |
| 6,879,789 | B2 | 4/2005 | Yamada et al. |
| 6,920,298 | B2 | 7/2005 | Yamada et al. |
| 6,990,301 | B2 | 1/2006 | Yamada et al. |
| 7,127,193 | B2 | 10/2006 | Yamada et al. |
| 7,412,192 | B2 | 8/2008 | Nakajima et al. |
| 7,469,113 | B2 | 12/2008 | Yamada et al. |
| 7,593,672 | B2 | 9/2009 | Woo |
| 7,835,674 | B2 | 11/2010 | Woo |
| 7,836,921 | B2 | 11/2010 | Isomura et al. |
| 7,848,685 | B2 | 12/2010 | Nagashima et al. |
| 7,925,184 | B2 | 4/2011 | Yamada |
| 8,160,471 | B2 | 4/2012 | Jimba et al. |
| 8,204,408 | B2 | 6/2012 | Takayama |
| 8,229,328 | B2 | 7/2012 | Yamamoto |
| 8,565,649 | B2 | 10/2013 | Murakami et al. |
| 8,897,678 | B2 | 11/2014 | Yamanaka |
| 9,073,699 | B2 | 7/2015 | Yamada et al. |
| 9,304,438 | B2 | 4/2016 | Shimizu et al. |
| 9,354,550 | B2 | 5/2016 | Murakami et al. |
| 9,354,551 | B2 | 5/2016 | Murakami et al. |
| 9,465,317 | B2 | 10/2016 | Kikuchi et al. |
| 9,720,349 | B2 | 8/2017 | Yamaoka et al. |
| 9,753,402 | B2 | 9/2017 | Murakami et al. |
| 9,857,729 | B2 | 1/2018 | Kikuchi et al. |
| 9,996,028 | B2 | 6/2018 | Yomoda et al. |
| 10,048,621 | B2 | 8/2018 | Kikuchi et al. |
| 10,088,773 | B2 | 10/2018 | Yamaoka et al. |
| 10,203,631 | B2 | 2/2019 | Murakami et al. |
| 10,209,667 | B2 | 2/2019 | Jimba et al. |
| 10,289,060 | B2 | 5/2019 | Jimba et al. |
| 10,289,061 | B2 | 5/2019 | Jimba et al. |
| 10,295,957 | B2 | 5/2019 | Jimba et al. |
| 10,401,760 | B2 | 9/2019 | Kikuchi et al. |
| 10,627,742 | B2 | 4/2020 | Yomoda et al. |
| 10,670,990 | B2 | 6/2020 | Kikuchi et al. |
| 10,908,532 | B2 | 2/2021 | Kikuchi et al. |
| 11,237,499 | B2 | 2/2022 | Yomoda et al. |
| 2002/0025195 | A1 | 2/2002 | Iwata et al. |
| 2008/0219706 | A1 | 9/2008 | Takayama |
| 2008/0304868 | A1 | 12/2008 | Woo |
| 2012/0014713 | A1 | 1/2012 | Murakami et al. |
| 2013/0017001 | A1 | 1/2013 | Yamanaka |
| 2014/0076691 | A1 | 3/2014 | Yamada et al. |
| 2014/0153974 | A1 | 6/2014 | Jimba et al. |
| 2016/0124348 | A1 | 5/2016 | Yamada et al. |
| 2017/0307999 | A1 | 10/2017 | Yamaoka et al. |
| 2018/0101129 | A1 | 4/2018 | Jimba et al. |
| 2019/0018340 | A1 | 1/2019 | Yamaoka et al. |
| 2019/0018341 | A1 | 1/2019 | Yamaoka et al. |
| 2019/0155208 | A1 | 5/2019 | Jimba et al. |
| 2019/0155209 | A1 | 5/2019 | Jimba et al. |
| 2019/0155210 | A1 | 5/2019 | Jimba et al. |
| 2019/0155211 | A1 | 5/2019 | Jimba et al. |
| 2019/0155212 | A1 | 5/2019 | Jimba et al. |
| 2021/0132524 | A1 | 5/2021 | Kikuchi et al. |
| 2022/0128932 | A1 | 4/2022 | Yomoda et al. |

FOREIGN PATENT DOCUMENTS

| | | | |
|---|---|---|---|
| CN | 101261472 | A | 9/2008 |
| CN | 101436023 | A | 5/2009 |
| CN | 101872141 | A | 10/2010 |
| CN | 102880028 | A | 1/2013 |
| CN | 103534652 | A | 1/2014 |
| CN | 103733141 | A | 4/2014 |
| CN | 104007640 | A | 8/2014 |
| CN | 106483796 | A | 3/2017 |
| EP | 2 416 222 | A1 | 8/2012 |
| EP | 2 801 866 | A1 | 12/2014 |
| EP | 2 889 695 | A1 | 1/2015 |
| JP | 11-296042 | A | 10/1999 |
| JP | 2000-284594 | A | 10/2000 |
| JP | 2001-075349 | A | 3/2001 |
| JP | 2007-041399 | A | 2/2007 |
| JP | 2007-178971 | A | 7/2007 |
| JP | 2008-309858 | A | 12/2008 |
| JP | 2009-122362 | A | 6/2009 |
| JP | 2013-195651 | A | 9/2013 |
| JP | 2013-218060 | A | 10/2013 |
| JP | 2014-178655 | A | 9/2014 |
| JP | 2014-182266 | A | 9/2014 |
| JP | 2015-087528 | A | 5/2015 |
| KR | 10-2012-0000568 | A | 1/2012 |
| WO | 2013/128844 | A1 | 9/2013 |
| WO | 2014/147845 | A1 | 9/2014 |

OTHER PUBLICATIONS

Great Britain Search Report dated Mar. 26, 2018, in related Great Britain Patent Application No. GB1716187.8.

Korean Office Action dated Dec. 18, 2018, in related Korean Patent Application No. 10-2016-0105203.

German Office Action dated Apr. 24, 2019, in related German Patent Application No. 10 2016 115 818.6 (with English translation).

Japanese Office Action dated Apr. 16, 2019, in related Japanese Patent Application No. 2015-167526.

Korean Notice of Allowance dated Oct. 22, 2019, in related Korean Patent Application No. 10-2016-0105203.

Chinese Office Action dated May 30, 2019, in related Chinese Patent Application No. 201610725194.0 (with English translation).

Japanese Office Action dated Jul. 7, 2020, in related Japanese Patent Application No. 2019-139421.

Chinese Office Action dated Apr. 28, 2022, in related Chinese Patent Application No. 202010375923.0 (with English translation).

Chinese Office Action dated Apr. 7, 2022, in related Chinese Patent Application No. 202010375922.5 (with English translation).

DEVELOPER REPLENISHING CONTAINER AND IMAGE FORMING APPARATUS

This application is a divisional of application Ser. No. 16/829,011, filed Mar. 25, 2020, which is a divisional of application Ser. No. 16/282,489, filed Feb. 22, 2019, now U.S. Pat. No. 10,627,742, issued Jul. 21, 2020, which is a divisional of application Ser. No. 15/969,953, filed May 3, 2018, now abandoned, which is a divisional of application Ser. No. 15/226,141, filed Aug. 2, 2016, now U.S. Pat. No. 9,996,028, issued Jun. 12, 2018.

BACKGROUND OF THE INVENTION

Field of the Invention

The present invention relates to a developer replenishing container attachable and detachable to/from a developer replenishing apparatus. The developer replenishing container is used in an image forming apparatus such as a copier, a facsimile, a printer and a multifunction peripheral having a plurality of these functions.

Description of the Related Art

Conventionally, a fine powder developer is used in an image forming apparatus such as an electrophotographic copier. In the image forming apparatus, a developer which is consumed as images are formed is replenished from a developer replenishing container.

As a conventional developer replenishing container, there is the developer replenishing container described in Japanese Patent Application Laid-Open No. 2008-309858, for example. In the developer replenishing container described in Japanese Patent Application Laid-Open No. 2008-309858, a discharge port has a relatively small size so as to suppress the scattering of a developer from the discharge port during normal working (exchange work) of the developer replenishing container. In Japanese Patent Application Laid-Open No. 2008-309858, since the discharge port is small, for aggregation of the developer generated at the discharge port or in a discharge path, the aggregation of the developer is addressed using a reciprocating member. Thus, the developer can be successfully discharged from the relatively small discharge port over a long period of time.

The developer replenishing container described in Japanese Patent Application Laid-Open No. 2008-309858 is provided with a driving force conversion member including a complicated crank mechanism in order to convert rotary driving force of a developer containing part to reciprocating driving force of the reciprocating member in order to drive the reciprocating member.

SUMMARY OF THE INVENTION

An object of the present invention is to provide a developer replenishing container and an image forming apparatus capable of dissolving aggregation of a developer by a simple configuration.

Another object of the present invention is to provide a developer replenishing container including: a developer containing part capable of containing a developer; a discharge port through which the developer contained in the developer containing part is discharged; a conveyance part conveying the developer in the developer containing part by rotating; and a displacement part displaceable in conjunction with rotation of the conveyance part in the developer in a vicinity of the discharge port, and including a moving member capable of reciprocating in conjunction with the rotation of the conveyance part and a biasing member which biases the moving member and which is expandable according to movement of the moving member.

In addition, another object of the present invention is to provide an image forming apparatus including: a developer receiving apparatus including a developer receiving part which receives a developer, and a drive part which imparts driving force to a developer replenishing container; and the developer replenishing apparatus detachable from the developer receiving apparatus and having: a developer containing part capable of containing the developer; a discharge port through which the developer contained in the developer containing part is discharged to the developer receiving part; a conveyance part conveying the developer in the developer containing part by receiving the drive force from the drive part to rotate; and a displacement part displaceable in conjunction with rotation of the conveyance part in the developer in a vicinity of the discharge port, and including a moving member capable of reciprocating in conjunction with the rotation of the conveyance part and a biasing member which biases the moving member and which is expandable according to movement of the moving member.

Further features of the present invention will become apparent from the following description of exemplary embodiments with reference to the attached drawings.

DESCRIPTION OF THE EMBODIMENTS

Preferred embodiments of the present invention will now be described in detail in accordance with the accompanying drawings.

First Embodiment

First, a basic configuration of an image forming apparatus will be described, and subsequently, configurations of a developer replenishing apparatus and a developer replenishing container loaded on the image forming apparatus will be described in order.

Below, unless described particularly, various configurations of the developer replenishing container can be replaced with other known configurations that have similar functions within the scope of ideas of the invention.

<Image Forming Apparatus>

As one example of the image forming apparatus loaded with the developer replenishing apparatus on which the developer replenishing container (so called, a toner cartridge) is attachably (detachably) mounted, a configuration of a copier adopting an electrophotographic system (an electrophotographic image forming apparatus) will be described using FIG. 1.

Figure 1:
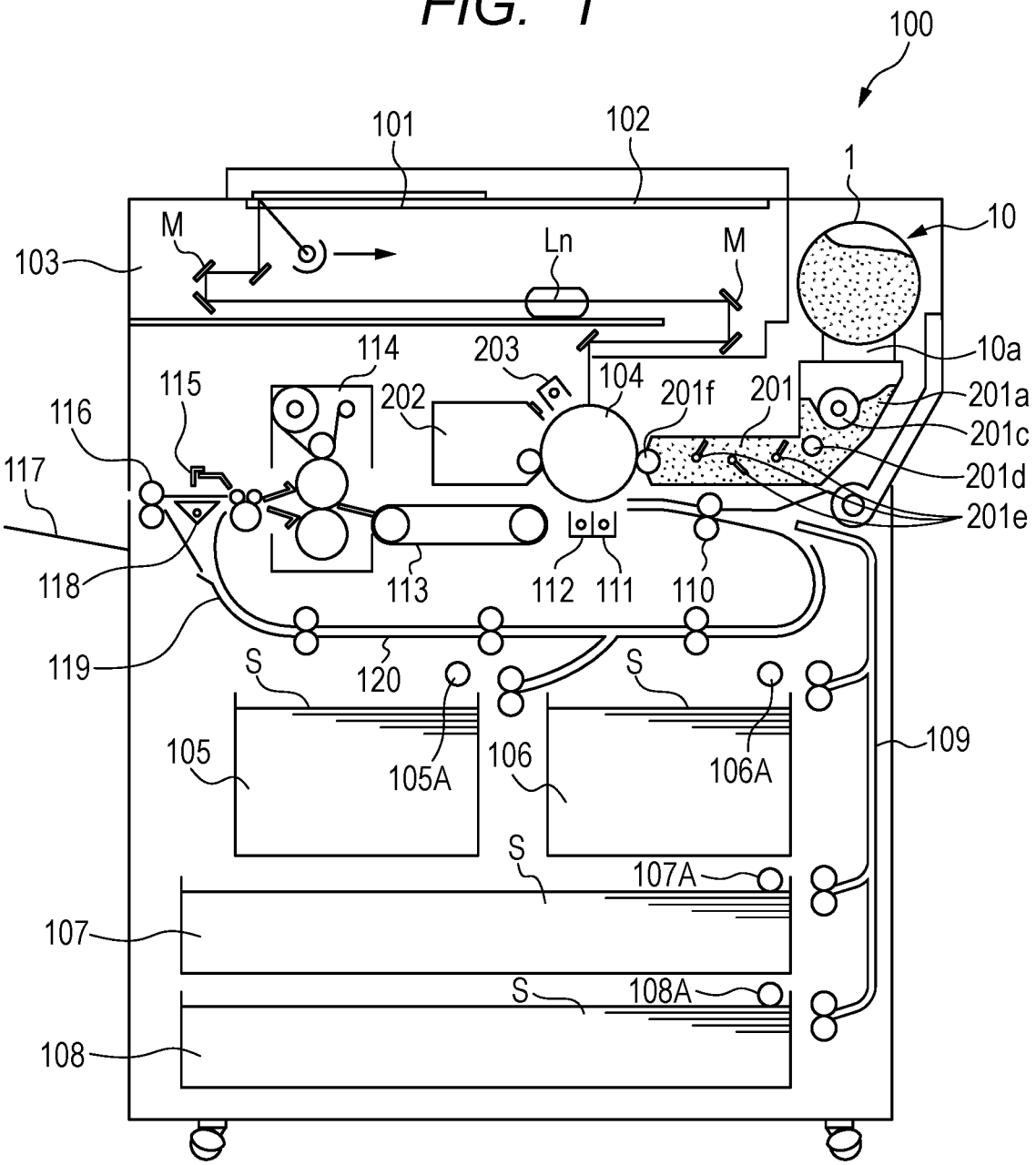
FIG. 1 is a sectional view illustrating an entire configuration of an image forming apparatus.

FIG. 1 illustrates a copier main body (referred to as an image forming apparatus main body or an apparatus main body, hereinafter) 100. In addition, an original 101 is placed on original platen glass 102. Then, by imaging an optical image according to image information of the original on an electrophotographic photosensitive member 104 (a photosensitive member, hereinafter) by a plurality of mirrors M and a lens Ln, an electrostatic latent image is formed. The electrostatic latent image is visualized using toner (one-component magnetic toner) as a developer (dry type powder) by a dry type developing device (one-component developing device) 201*a*.

In the present embodiment, an example using the one-component magnetic toner as the developer to be replenished from a developer replenishing container 1 will be described. However, not only such an example but also a configuration described later may be adopted.

Specifically, in the case of using a one-component developing device which performs developing using one-component nonmagnetic toner, the one-component nonmagnetic toner is replenished as a developer. In the case of using a two-component developing device which performs developing using a two-component developer in which a magnetic carrier and nonmagnetic toner are mixed, the nonmagnetic toner is replenished as the developer. In this case, the magnetic carrier may be replenished together with the nonmagnetic toner as the developer.

Cassettes 105, 106, 107 and 108 accommodate sheets S (recording media). Among these cassettes 105-108 in which the sheets S are stacked, an optimum cassette is selected based on information input by an operator (user) from a liquid crystal operation part of the copier or a sheet size of the original 101.

One sheet S conveyed by feeding and separating apparatuses 105A, 106A, 107A and 108A is conveyed through a conveyance part 109 to resist rollers 110. The sheet S is conveyed while synchronizing timing of scan of an optical part 103 with rotation of the photosensitive member 104.

FIG. 1 illustrates a transfer charger 111 and a separating charger 112. By the transfer charger 111, an image formed by the developer on the photosensitive member 104 is transferred to the sheet S. By the separating charger 112, the sheet S to which a developer image (toner image) is transferred is separated from the photosensitive member 104.

Thereafter, for the sheet S conveyed by a conveyance part 113, the developer image on the sheet is fixed by heat and a pressure in a fixing part 114. Then, in the case of simplex copy, the sheet S passes through a discharge reverse part 115 and is discharged to a discharge tray 117 by discharge rollers 116.

In the case of duplex copy, the sheet S passes through the discharge reverse part 115, and a part of the sheet is once discharged to the outside of the apparatus by the discharge rollers 116. Thereafter, at the timing that a trailing end of the sheet S passes through a flapper 118 and is still clamped by the discharge rollers 116, the flapper 118 is controlled and the discharge rollers 116 are inversely rotated. Thus, the sheet S is conveyed again into the apparatus. Thereafter, the sheet S is conveyed through re-feeding conveyance parts 119 and 120 to the resist rollers 110. Then, the sheet S is discharged to the discharge tray 117 through a route similar to the case of the simplex copy.

In the apparatus main body 100, image forming process devices such as a developing device 201*a* as a developing unit, a cleaner part 202 as a cleaning unit, a primary charger 203 as a charging unit are installed around the photosensitive member 104. The developing device 201*a* performs developing by applying the developer to the electrostatic latent image formed on the photosensitive member 104 by the optical part 103 based on the image information of the original 101. The primary charger 203 uniformly charges a surface of the photosensitive member in order to form a desired electrostatic image on the photosensitive member 104. The cleaner part 202 removes the developer remaining on the photosensitive member 104.

<Developer Replenishing Apparatus>

Figure 2A:
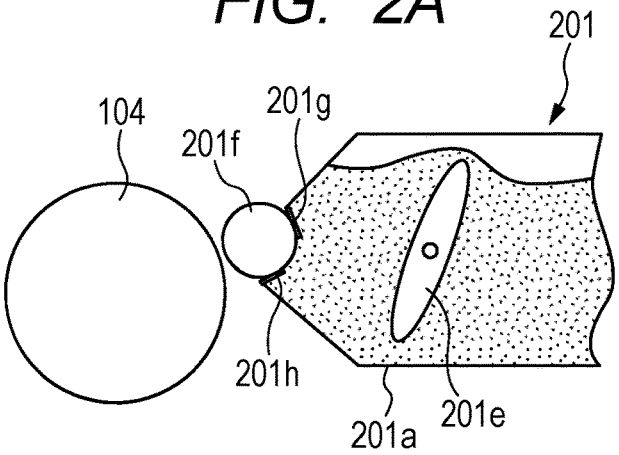
FIG. 2A is a partial sectional view of a developer replenishing apparatus.
Figure 2B:
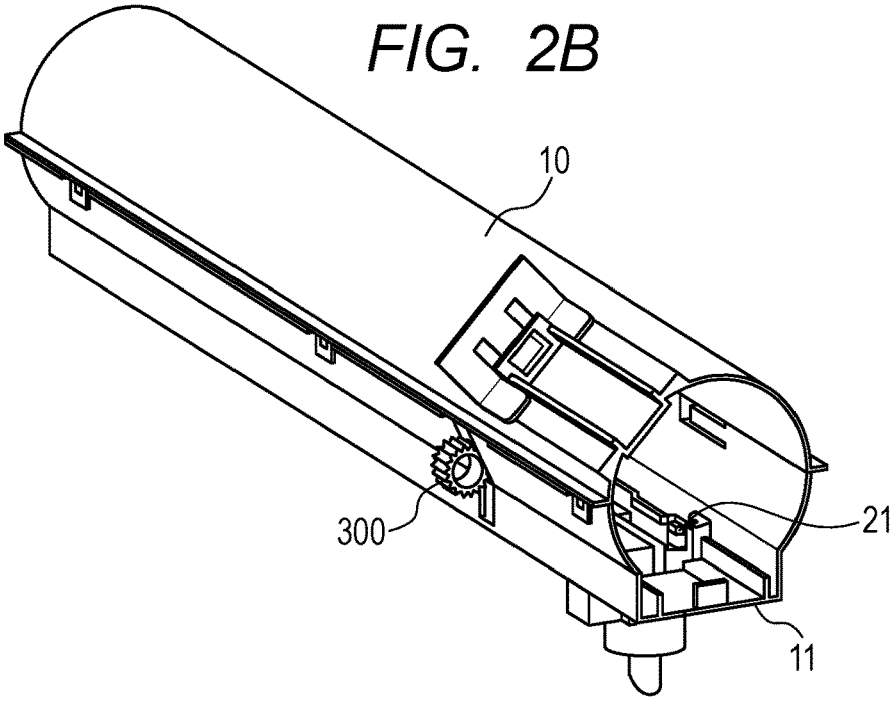
FIG. 2B is a perspective view of a mounting part.
Figure 2C:
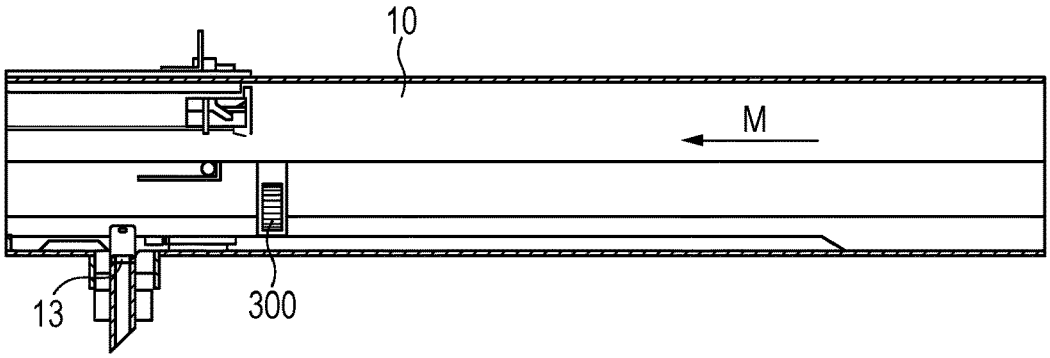
FIG. 2C is a sectional view of the mounting part.
Figure 3:
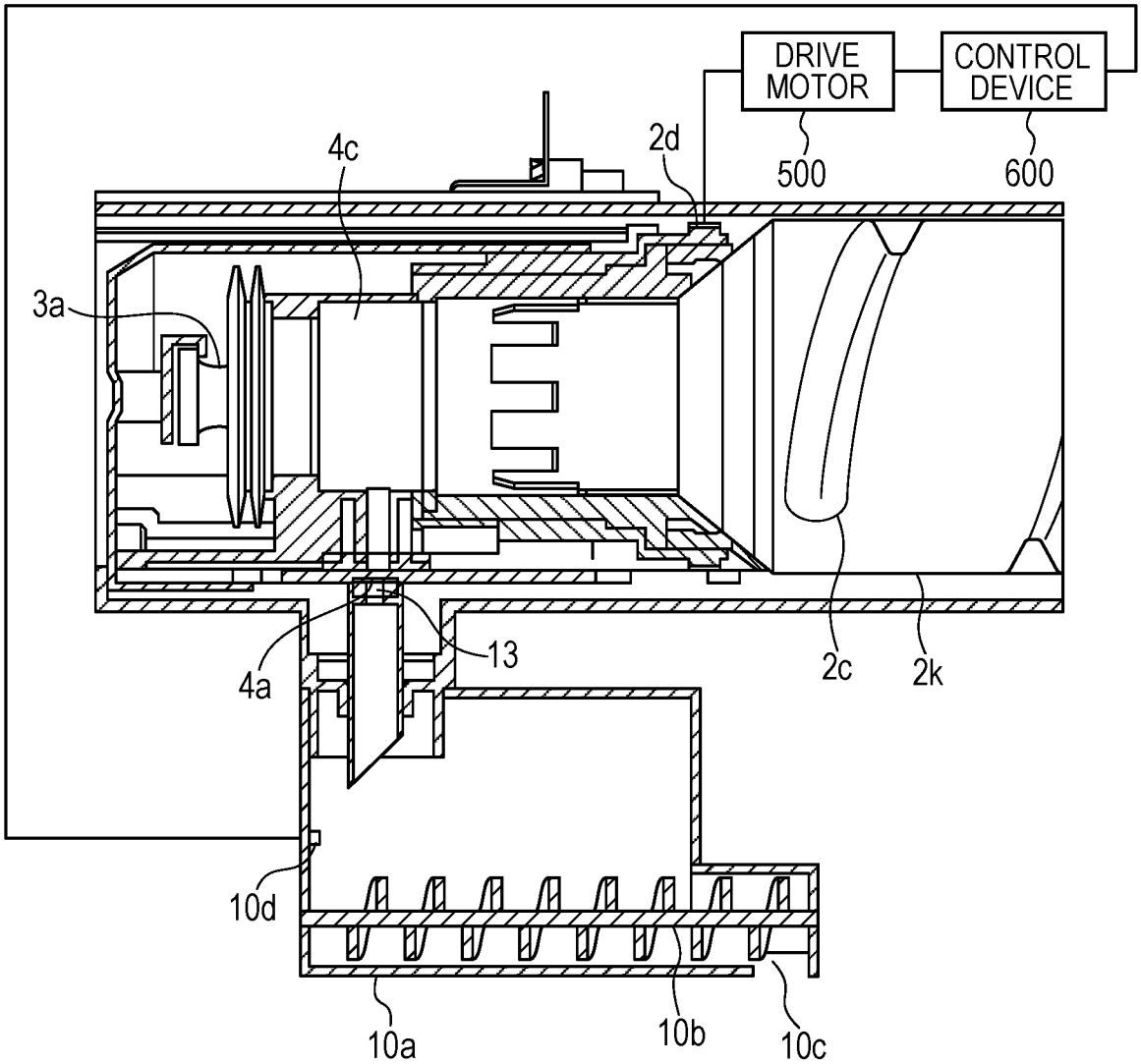
FIG. 3 is an enlarged sectional view illustrating a developer replenishing container and the developer replenishing apparatus.
Figure 4:
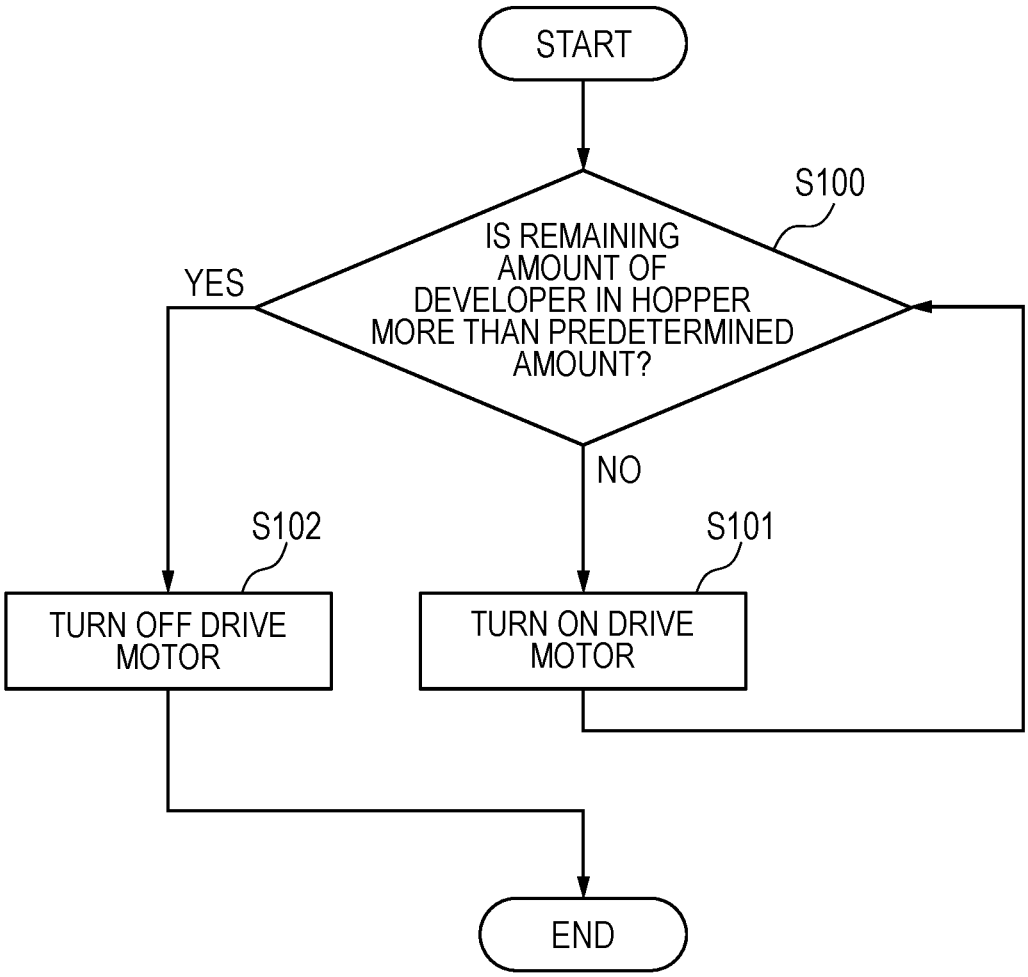
FIG. 4 is a flowchart illustrating a flow of developer replenishment.

A developer replenishing apparatus 201 which is a component of a developer replenishing system will be described using FIG. 1 to FIG. 4. FIG. 2A is a partial sectional view of the developer replenishing apparatus 201, FIG. 2B is a perspective view of a mounting part 10 to which the developer replenishing container 1 is mounted, FIG. 2C is a sectional view of the mounting part 10. FIG. 3 illustrates a sectional view in which a control system, the developer replenishing container 1 and the developer replenishing apparatus 201 are partially enlarged. FIG. 4 is a flowchart illustrating a flow of developer replenishment by the control system.

The developer replenishing apparatus 201 includes, as illustrated in FIG. 1, the mounting part (mounting space) to which the developer replenishing container 1 is detachably (attachably) mounted, a hopper 10*a* that temporary stores the developer discharged from the developer replenishing container 1, and the developing device 201*a*. The developer replenishing container 1 is, as illustrated in FIG. 2C, mounted in a direction of an arrow M to the mounting part 10. That is, the developer replenishing container 1 is mounted to the mounting part 10 such that a longitudinal direction (rotation axis direction) of the developer replenishing container 1 substantially coincides with the direction of the arrow M. The direction of the arrow M is practically parallel to a direction of an arrow X in FIG. 7B. A detaching direction of the developer replenishing container 1 from the mounting part 10 is a direction opposite to the direction of the arrow M.

The developing device 201*a* includes, as illustrated in FIG. 1 and FIG. 2A, a developing roller 201*f*, a mixing member 201*c*, and feeding members 201*d* and 201*e*. The developer replenished from the developer replenishing container 1 is mixed by the mixing member 201*c*, fed to the developing roller 201*f* by the feeding members 201*d* and 201*e*, and supplied to the photosensitive member 104 by the developing roller 201*f*.

The developing roller 201*f* is provided with a developing blade 201*g* that regulates a developer coating amount on the roller, and a leakage prevention sheet 201*h* arranged in contact with the developing roller 201*f* in order to prevent leakage of the developer from between the developing device 201*a* and the developing roller 201*f*.

The mounting part 10 is, as illustrated in FIG. 2B, provided with a rotation direction regulating part (holding mechanism) 11 for regulating movement of a flange part 4 (see FIG. 6A) of the developer replenishing container 1 in a rotation direction by being in contact with the flange part 4 when the developer replenishing container 1 is mounted.

In addition, the mounting part 10 includes a developer receiving port (developer receiving hole) 13 for receiving the developer discharged from the developer replenishing container 1. The developer receiving port 13 communicates with a discharge port (discharge hole) 4*a* (see FIG. 6B) of the developer replenishing container 1 when the developer replenishing container 1 is mounted. The developer is supplied from the discharge port 4*a* of the developer replenishing container 1 through the developer receiving port 13 to the developing device 201*a*. In the present embodiment, a diameter ϕ of the developer receiving port 13 is set at about 2 mm as a fine port (pinhole) for a purpose of preventing stains by the developer in the mounting part as much as possible. The diameter of the developer receiving port may be such a diameter that the developer can be discharged from the discharge port 4*a*.

The hopper 10*a* is, as illustrated in FIG. 3, provided with a conveyance screw 10*b* for conveying the developer to the developing device 201*a*, an opening 10*c* communicated with the developing device 201*a*, and a developer sensor 10*d* that detects an amount of the developer contained in the hopper 10*a*.

The mounting part 10 includes, as illustrated in FIGS. 2B and 2C, a drive gear 300 that functions as a drive mechanism (drive part). The drive gear 300 has a function of receiving rotary driving force transmitted from a drive motor 500 through a drive gear train and imparting the rotary driving force to the developer replenishing container 1 in the state of being set to the mounting part 10.

As illustrated in FIG. 3, the operation of the drive motor 500 is controlled by a control device (CPU) 600. The control device 600 is configured to control the operation of the drive motor 500 based on developer residual amount information input from the developer sensor 10*d*, as illustrated in FIG. 3.

In the present embodiment, the drive gear 300 is set to rotate only in one direction in order to simplify the control of the drive motor 500. That is, the control device 600 is configured to control only ON (operation)/OFF (non-operation) of the drive motor 500. Thus, compared to a configuration of imparting reverse driving force, which is obtained by cyclically inverting the drive motor 500 (the drive gear 300) to a forward direction and a reverse direction, to the developer replenishing container 1, the drive mechanism of the developer replenishing apparatus 201 can be simplified.

<Method of Mounting/Taking Out Developer Replenishing Container>

A method of mounting/taking out the developer replenishing container 1 will be described.

First, an operator opens an exchange cover, and inserts and mounts the developer replenishing container 1 to the mounting part 10 of the developer replenishing apparatus 201. Accompanying this mounting operation, the flange part 4 of the developer replenishing container 1 is held by and fixed to the developer replenishing apparatus 201.

Thereafter, when the operator closes the exchange cover, a mounting process ends. Then, the control device 600 controls the drive motor 500 to rotate the drive gear 300 at appropriate timing.

In the case that the developer in the developer replenishing container 1 becomes empty, the operator opens the exchange cover, and takes out the developer replenishing container 1 from the mounting part 10. Then, the operator inserts and mounts a prepared new developer replenishing container 1 to the mounting part 10, and closes the exchange cover. Thus, exchange work from the takeout to re-mounting of the developer replenishing container 1 ends.

<Developer Replenishment Control by Developer Replenishing Apparatus>

Developer replenishment control by the developer replenishing apparatus 201 will be described based on the flowchart in FIG. 4. The developer replenishment control is executed by controlling various kinds of devices by the control device 600.

In the present embodiment, by the control device 600 controlling the operation/non-operation of the drive motor 500 according to output of the developer sensor 10*d*, a predetermined amount or more of the developer is not contained in the hopper 10*a*.

Specifically, first, the developer sensor 10*d* checks a developer containing amount in the hopper 10*a* (S100). Then, when it is determined that the developer containing amount detected by the developer sensor 10*d* is smaller than a predetermined amount (that is, when the developer is not detected by the developer sensor 10*d*), the drive motor 500 is driven and a developer replenishing operation is executed for a predetermined period of time (S101).

When it is determined that the developer containing amount detected by the developer sensor 10*d* has reached the predetermined amount (that is, when the developer is detected by the developer sensor 10*d*) as a result of the developer replenishing operation, drive of the drive motor 500 is turned off, and the developer replenishing operation is stopped (S102). By stopping the replenishing operation, a series of developer replenishing processes ends.

The developer replenishing process is repeatedly executed when the developer is consumed as images are formed and the developer containing amount in the hopper 10*a* becomes smaller than the predetermined amount.

In such a manner, the developer discharged from the developer replenishing container 1 may be temporary stored in the hopper 10*a* and replenished to the developing device 201*a* thereafter, however, the developer replenishing apparatus 201 may be also configured as follows.

Figure 5:
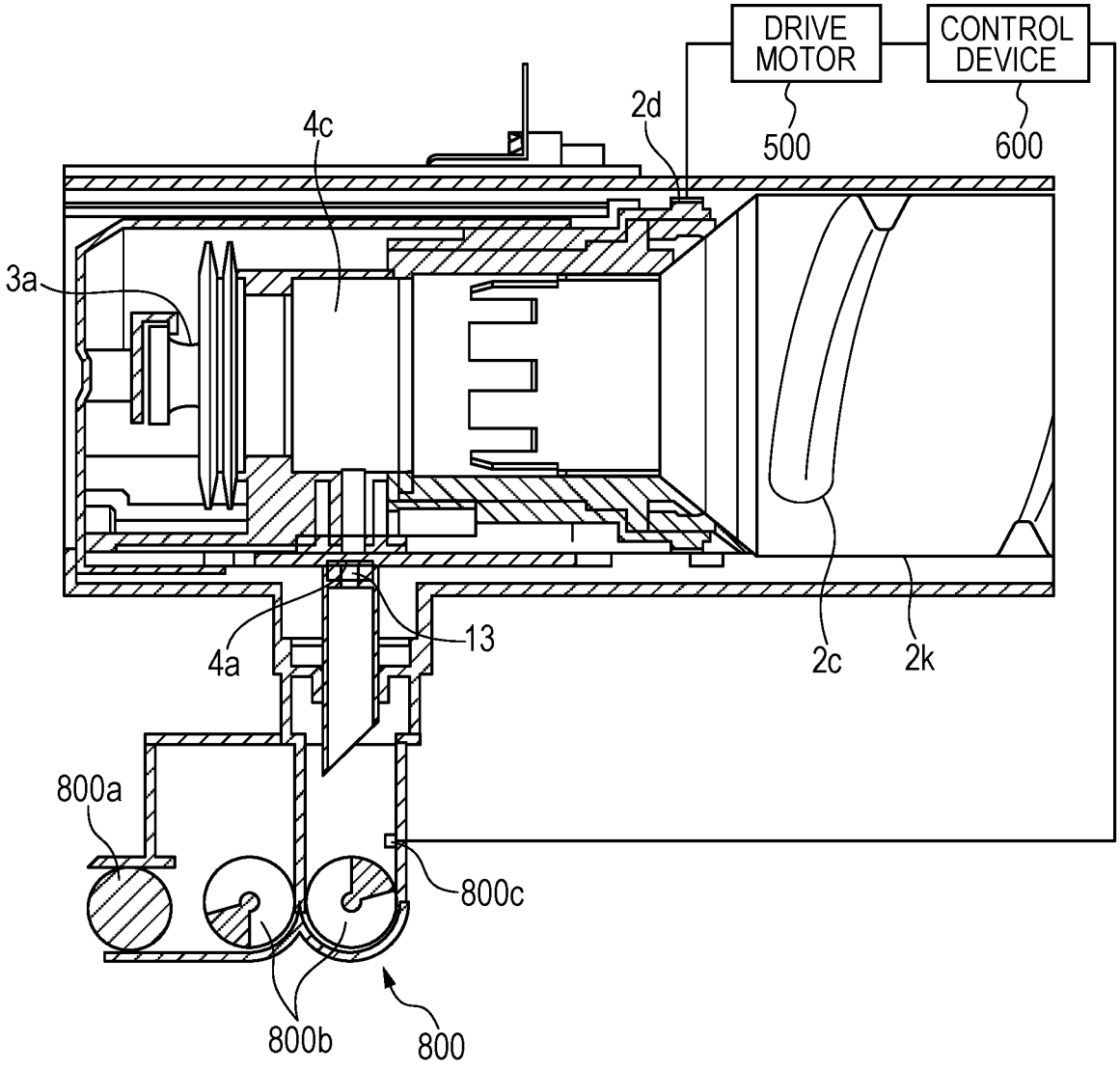
FIG. 5 is an enlarged sectional view illustrating a modification of the developer replenishing apparatus.

Specifically, as illustrated in FIG. 5, the above-described hopper 10*a* is omitted, and the developer is directly replenished from the developer replenishing container 1 to the developing device 201*a*. FIG. 5 illustrates an example of using a two-component developing device 800 as the developer replenishing apparatus 201. The developing device 800 includes a mixing chamber to which the developer is replenished and a developing chamber that supplies the developer to a developing sleeve 800*a*. To the mixing chamber and the developing chamber, mixing screws 800*b* whose developer conveyance directions are opposite to each other are installed. The mixing chamber and the developing chamber are communicated to each other at both ends in the longitudinal direction, and the two-component developer is circulated and conveyed in these two chambers. A magnetic sensor 800*c* that detects a toner density in the developer is installed in the mixing chamber, and the control device 600 controls the operation of the drive motor 500 based on a detection result of the magnetic sensor 800*c*. In the case of this configuration, the developer replenished from the developer replenishing container is the nonmagnetic toner or the nonmagnetic toner and the magnetic carrier.

In the present embodiment, since the developer in the developer replenishing container 1 is hardly discharged only by a gravity action from the discharge port 4*a* and the developer is discharged by a volume varying operation by a pump part 3*a*, dispersion of a discharge amount can be suppressed. Therefore, the hopper 10*a* can be omitted, and even in the example as in FIG. 5, the developer can be stably replenished to the developing chamber.

<Developer Replenishing Container>

Figure 6A:
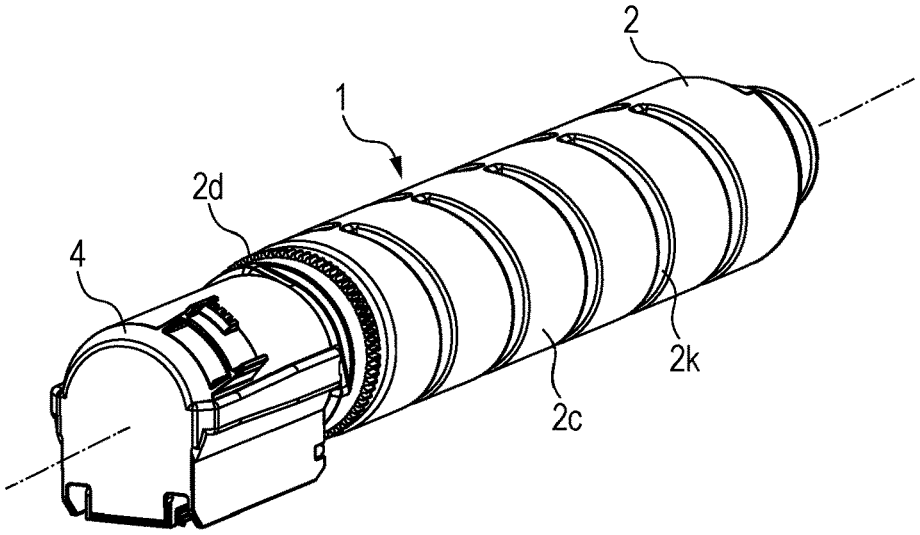
FIG. 6A is a perspective view illustrating the developer replenishing container.
Figure 6B:
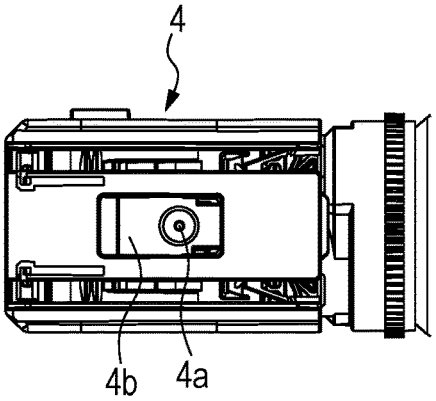
FIG. 6B is a partial enlarged view illustrating a situation around a discharge port.
Figure 6C:
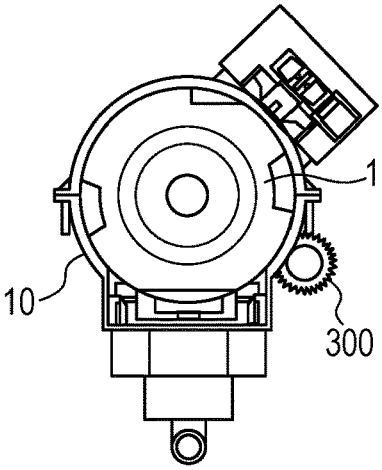
FIG. 6C is a front view illustrating a state of the developer replenishing container mounted to the mounting part of the developer replenishing apparatus.
Figure 7A:
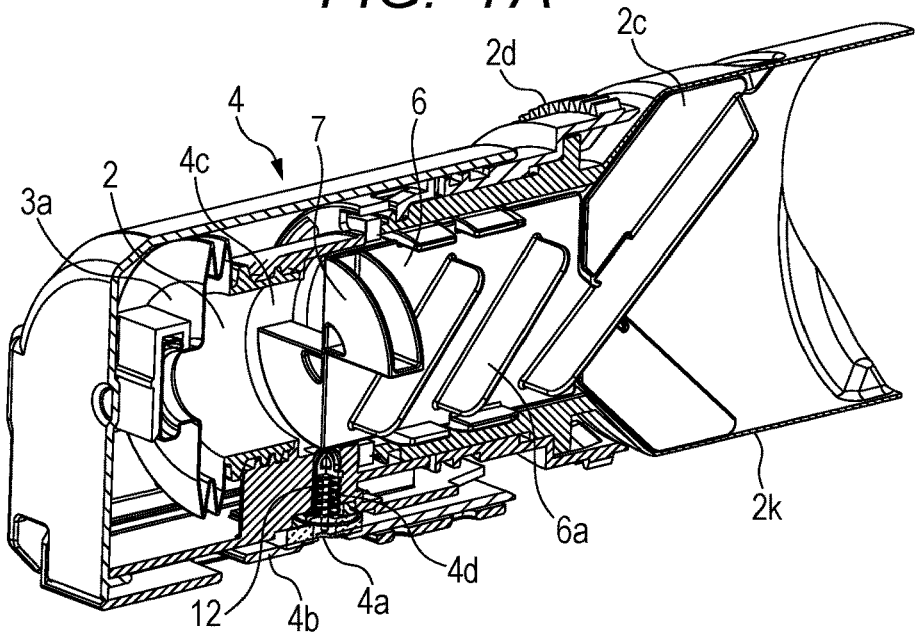
FIG. 7A is a sectional perspective view of the developer replenishing container.

The configuration of the developer replenishing container 1 which is a component of the developer replenishing system will be described using FIGS. 6A, 6B and 6C and FIGS. 7A, 7B and 7C. FIG. 6A is an entire perspective view of the developer replenishing container 1, FIG. 6B is a partial enlarged view of the vicinity of the discharge port 4*a* of the developer replenishing container 1, and FIG. 6C is a front view illustrating a state of mounting the developer replenishing container 1 to the mounting part 10. FIG. 7A is a sectional perspective view of the developer replenishing container, FIG. 7B is a partial sectional view of a state that the pump part is maximally expanded for use, and FIG. 7C is a partial sectional view of a state that the pump part is maximally contracted for use.

The developer replenishing container 1 includes, as illustrated in FIG. 6A, a developer containing part 2 (container main body) formed in a hollow cylindrical shape and having an internal space in which the developer is accommodated. In the present embodiment, a cylinder part 2*k*, a discharge part 4*c* (see FIG. 5), and the pump part 3*a* (see FIG. 5) function as the developer containing part 2. Further, the developer replenishing container 1 includes the flange part 4 (also referred to as a non-rotation part) on one end side in the longitudinal direction (developer conveyance direction) of the developer containing part 2. The cylinder part 2*k* is configured relatively rotatably to the flange part 4. A sectional shape of the cylinder part 2*k* may be a non-circular shape within a range of not affecting a rotating operation in the developer replenishing process. For example, an elliptic shape or a polygonal shape may be adopted.

Figure 7B:
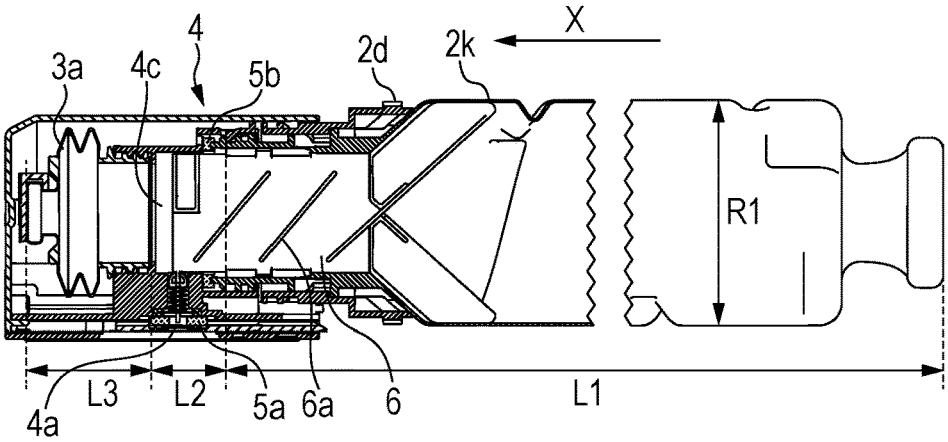
FIG. 7B is a partial sectional view of a state that a pump part is maximally expanded for use.
Figure 7C:
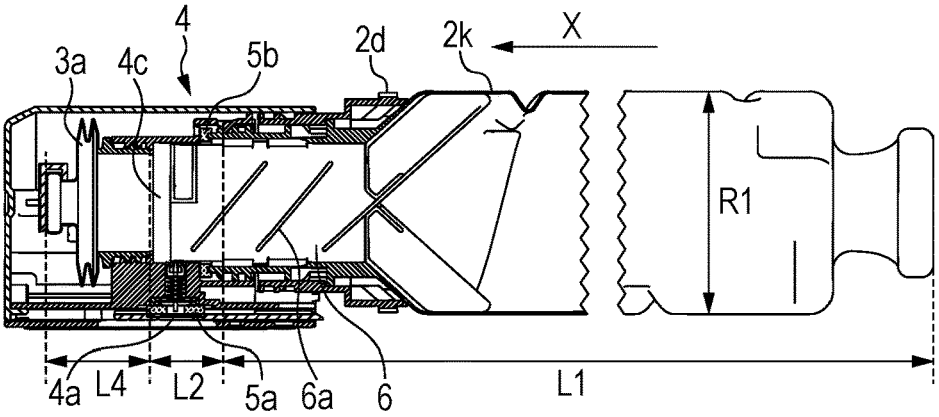
FIG. 7C is a partial sectional view of a state that the pump part is maximally contracted for use.

In the present embodiment, as illustrated in FIG. 7B, an entire length L1 of the cylinder part 2*k* that functions as a developer containing chamber is set at about 460 mm and an outer diameter R1 is set at about 60 mm. A length L2 of an area, where the discharge part 4*c* that functions as a developer discharge chamber is installed, is about 21 mm. The entire length L3 (in the state of being maximally expanded in an expandable/contractible range for use) of the pump part 3*a* is about 29 mm. As illustrated in FIG. 7C, an entire length L4 (in the state of being maximally contracted in the expandable/contractible range for use) of the pump part 3*a* is about 24 mm.

(Material of Developer Replenishing Container)

In the present embodiment, by changing a volume in the developer replenishing container 1 by the pump part 3*a*, the developer is discharged from the discharge port 4*a*.

As a material of the developer replenishing container 1, a material having such rigidity that the developer replenishing container 1 is not largely crushed or largely expanded by the change of the volume can be adopted. In the present embodiment, the developer replenishing container 1 is communicated with the outside only through the discharge port 4*a* when a developer T is discharged, and is sealed from the outside except for the discharge port 4*a*. That is, since the volume of the developer replenishing container 1 is reduced or increased by the pump part 3*a* and the developer is discharged from the discharge port 4*a*, enough airtightness to keep a stable discharge performance is demanded.

In the present embodiment, the material of the developer containing part 2 and the discharge part 4*c* is a polystyrene resin, and the material of the pump part 3*a* is a polypropylene resin. Regarding the material to be used, for the developer containing part 2 and the discharge part 4*c*, as long as it is a material that can withstand volume variation, for example, other resins such as ABS (acrylonitrile-butadiene-styrene copolymer), polyester, polyethylene, or polypropylene can be used. Also, the developer containing part 2 and the discharge part 4*c* may be made of a metal. The material of the pump part 3*a* may be a material capable of exhibiting an expandable/contractible function and changing the volume of the developer replenishing container 1 by the volume change. For example, it may be ABS (acrylonitrile-butadiene-styrene copolymer), polystyrene, polyester or polyethylene that is formed thinly. In addition, rubber or other expandable and contractible materials can be used. When a thickness of the resin material is adjusted and the pump part 3*a*, the developer containing part 2 and the discharge part 4*c* respectively satisfy the above-described function, they may be integrally molded using an injection molding method or a blow molding method for example with the same material, respectively.

Hereinafter, the configuration of the flange part 4, the cylinder part 2*k*, the pump part 3*a*, a drive input part and a drive conversion mechanism 2*e* (cam groove) in the developer replenishing container will be described in details in order.

<Flange Part>

The flange part 4 is provided with a hollow discharge part 4*c* (developer discharge chamber) for temporarily containing the developer conveyed from the cylinder part 2*k*, as illustrated in FIGS. 7A and 7B. At a bottom part of the discharge part 4*c*, a small discharge port 4*a* for allowing discharge of the developer to the outside of the developer replenishing container 1 (that is, replenishing the developer to the developer replenishing apparatus 201) is formed. Above the discharge port 4*a*, a developer storage part 4*d* capable of storing a predetermined amount of the developer before the discharge is provided. A size of the discharge port 4*a* will be described later.

The flange part 4 is provided with a shutter 4*b* that opens and closes the discharge port 4*a*. The shutter 4*b* is abutted against an abutting part 21 (see FIG. 2B) provided on the mounting part 10 accompanying a mounting operation of the developer replenishing container 1 to the mounting part 10. Therefore, the shutter 4*b* is slid relatively to the discharge part 4*c* in the rotation axis direction (the direction opposite to the M direction in FIG. 2C) of the cylinder part 2*k* accompanying the mounting operation of the developer replenishing container 1 to the mounting part 10. As a result, the discharge port 4*a* is exposed from the shutter 4*b* and an opening operation is completed.

At the point of time, the discharge port 4*a* is communicated with the developer receiving port 13 of the mounting part 10 since positions coincide, and the developer can be replenished from the developer replenishing container 1.

The flange part 4 becomes practically immobile when the developer replenishing container 1 is mounted to the mounting part 10 of the developer replenishing apparatus 201.

Specifically, the rotation direction regulating part 11 illustrated in FIG. 2B is provided so as to prevent the flange part 4 from rotating in the rotation direction of the cylinder part 2*k* by itself. Therefore, in the state that the developer replenishing container 1 is mounted on the developer replenishing apparatus 201, the discharge part 4*c* provided on the flange part 4 is also practically blocked from rotating in the rotation direction of the cylinder part 2*k* (movements such as backlash are allowed).

The cylinder part 2*k* rotates in the developer replenishing process without being regulated in the rotation direction by the developer replenishing apparatus 201.

<Conveyance Member>

As illustrated in FIGS. 7A, 7B and 7C, a plate-like conveyance member 6 for conveying the developer, which is conveyed from the cylinder part 2*k* with a spiral projection part (conveyance projection) 2*c*, to the discharge part 4*c* is provided. The conveyance member 6 configures a conveyance part that conveys the developer in the developer containing part by rotating. The conveyance member 6 is provided so as to substantially bisect a partial area of the developer containing part 2, and integrally rotates together with the cylinder part 2*k*. On both surfaces of the conveyance member 6, a plurality of inclined ribs 6*a* inclined to the side of the discharge part 4*c* with respect to the rotation axis direction of the cylinder part 2*k* is provided.

In the present embodiment, on an end of the conveyance member 6, a regulating part 7 capable of regulating inflow of the developer into the developer storage part 4*d* is provided. The regulating part 7 is, as illustrated in FIGS. 7A, 7B and 7C, positioned above the developer storage part 4*d*, and members having a sectorial shape with a central angle of 90° are arranged at symmetrical positions of 180° in the rotation direction.

The developer conveyed by the conveyance projection 2*c* is raked up from a lower part to an upper part in a vertical direction by the plate-like conveyance member 6 in conjunction with the rotation of the cylinder part 2*k*. Thereafter, the developer slides down on a surface of the conveyance member 6 by gravity as the rotation of the cylinder part 2*k* advances and is soon delivered to the side of the discharge part 4*c* by the inclined ribs 6*a*. Then, at the timing that the regulating part 7 passes through over the discharge part 4*c*, the developer is fed into the discharge part 4*c*. In the present embodiment, the inclined ribs 6*a* are provided on both surfaces of the conveyance member 6 so that the developer is fed into the discharge part 4*c* every time the cylinder part 2*k* rotates half around.

<Regarding Discharge Port of Flange Part>

In the present embodiment, the discharge port 4*a* of the developer replenishing container 1 is set at such a size that the developer is not sufficiently discharged only by the gravity action when the developer replenishing container is in a posture of replenishing the developer to the developer replenishing apparatus 201. That is, an opening size of the discharge port 4*a* is set small (also it is referred to as a fine port (pinhole)) so that the discharge of the developer from the developer replenishing container becomes insufficient only by the gravity action. In other words, the size of the opening is set so that the discharge port 4*a* is practically blocked by the developer.

Thus, the following effects can be expected.

(1) The developer hardly leaks out from the discharge port 4*a*.

(2) Excess discharge of the developer when the discharge port 4*a* is opened can be suppressed.

(3) The discharge of the developer can be made dominantly dependent on an exhaust operation by the pump part 3*a*.

The inventors conducted an experiment to verify what size the discharge port 4*a* that does not sufficiently discharge the developer only by the gravity action is to be set at.

The verification experiment (measuring method) and the determination criterion will be described below.

A rectangular parallelepiped container of a predetermined volume with a discharge port (circular-shaped) formed at the bottom center is prepared, 200 g of the developer is filled in the container, and then the container is shaken well in the state of sealing a filling port and blocking the discharge port to sufficiently dissolve the developer. For the rectangular parallelepiped container, the volume is about 1000 $cm^3$, and the size is 90 mm length×92 mm width×120 mm height. Thereafter, the discharge port is opened in the state of directing the discharge port vertically downwards as promptly as possible and an amount of the developer discharged from the discharge port is measured. At the time, the rectangular parallelepiped container is in the state of being completely sealed except for the discharge port. The verification experiment was conducted under an environment of a temperature 24° C. and relative humidity 55%. In the procedure described above, a developer type and the size of the discharge port are changed and the discharge amount is measured. In the present embodiment, when the amount of the discharged developer is equal to or smaller than 2 g, it is determined that the amount is ignorable and the discharge port is in the size that the developer is not sufficiently discharged only by the gravity action.

The developer used in the verification experiment is indicated in Table 1. Developer types are the one-component magnetic toner, the two-component nonmagnetic toner used in the two-component developing device, and a mixture of the two-component nonmagnetic toner and the magnetic carrier used in the two-component developing device. As physical property values indicating characteristics of these developers, other than an angle of repose indicating fluidity, fluid energy indicating loosening easiness of a developer layer was measured by a powder fluidity analyzer (FT4 Powder Rheometer made by Freeman Technology).

TABLE 1

| Developer | Toner volume average particle diameter | Configuration of developer | Angle of repose | Fluid energy (bulk density 0.5 g/cm$^3$) |
|---|---|---|---|---|
| A | 7 μm | Two-component nonmagnetic toner | 18° | $2.09 \times 10^{-3}$ J |
| B | 6.5 μm | Mixture of two-component nonmagnetic toner and carrier | 22° | $6.80 \times 10^{-4}$ J |
| C | 7 μm | One-component magnetic toner | 35° | $4.30 \times 10^{-4}$ J |
| D | 5.5 μm | Mixture of two-component nonmagnetic toner and carrier | 40° | $3.51 \times 10^{-3}$ J |
| E | 5 μm | Mixture of two-component nonmagnetic toner and carrier | 27° | $4.14 \times 10^{-3}$ J |

Figure 8A:
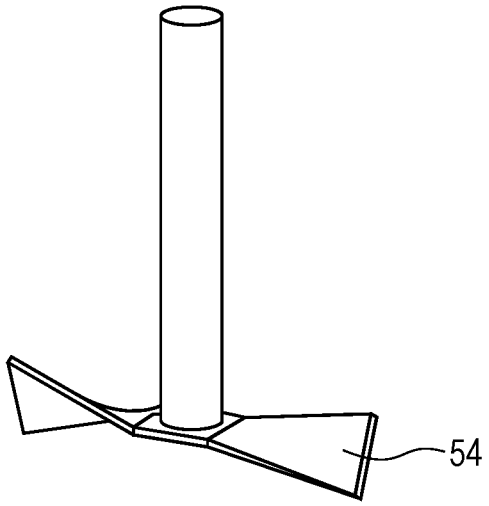
FIG. 8A is a perspective view of a blade used in an apparatus that measures fluid energy.
Figure 8B:
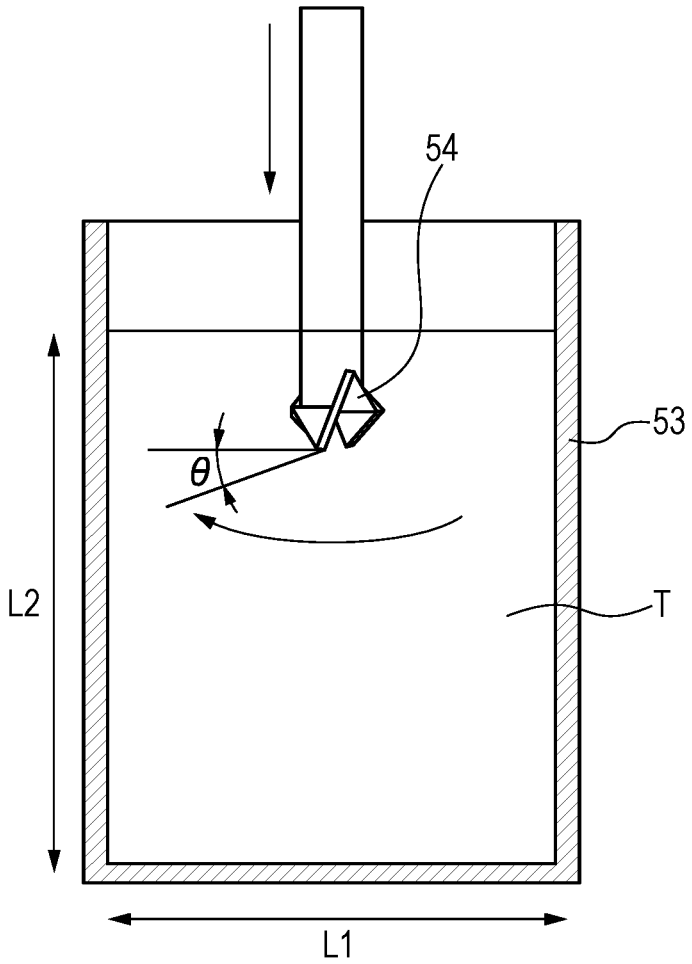
FIG. 8B is a schematic diagram of the apparatus.

A measuring method of the fluid energy will be described using FIGS. 8A and 8B. FIGS. 8A and 8B are schematic diagrams of an apparatus that measures the fluid energy. A principle of this powder fluidity analyzer is that a blade is moved in a powder sample and the fluid energy required for the blade to move in the powder is measured. The blade is a propeller type, rotates and simultaneously moves in a rotation axis direction so that a distal end of the blade draws spirals.

As a propeller type blade 54 (referred to as a blade, hereinafter), the blade (model number: C210) made of SUS which has a diameter of 48 mm and is smoothly twisted counterclockwise was used. For details, a rotating shaft exists in a normal direction with respect to a rotation surface of a blade plate at the center of the blade plate of 48 mm×10 mm, a torsion angle of both outermost edges (parts of 24 mm from the rotating shaft) of the blade plate is 70°, and a torsion angle of parts of 12 mm from the rotating shaft is 35°.

The fluid energy indicates total energy obtained by making the spirally rotating blade 54 enter a powder layer and time-integrating a total sum of rotary torque and a vertical load obtained when the blade moves in the powder layer. This value indicates the loosening easiness of the developer powder layer, and it means that the powder layer is hard to get loose when the fluid energy is large and the power layer is easy to get loose when the fluid energy is small.

In this measurement, as illustrated in FIG. 8B, in a cylindrical container 53 (volume 200 cc, L1 in FIG. 8B=50 mm) of ϕ 50 mm, which is a standard component of this apparatus, each developer T was filled such that a powder surface height becomes 70 mm (L2 in FIG. 8B). A filling amount is adjusted according to a bulk density to be measured. The blade 54 of ϕ 48 mm which is a standard component is made to enter the powder layer, and energy obtained in invasion depths between 10-30 mm is displayed.

As setting conditions for the time of the measurement, a rotation speed (tip speed, a peripheral speed of the outermost edge of the blade) of the blade 54 was set to 60 mm/s, and a blade approaching speed in a vertical direction to the powder layer was set to such a speed that an angle θ (helix angle. Referred to as a formed angle hereinafter) formed by a locus drawn by the outermost edge of the blade 54 during movement and a powder layer surface becomes 10°. The approaching speed in the vertical direction to the powder layer is 11 mm/s (the blade approaching speed in the vertical direction to the powder layer=the rotation speed of the blade×tan (the formed angle×π/180)). This measurement was also conducted under the environment of the temperature 24 C.° and the relative humidity 55%.

The bulk density of the developer when measuring the fluid energy of the developer was adjusted to 0.5 g/cm$^3$ as the bulk density which is close to the bulk density in the experiment of verifying a relationship between the discharge amount of the developer and the size of the discharge port and allows stable measurement with little change in the bulk density.

Figure 9:
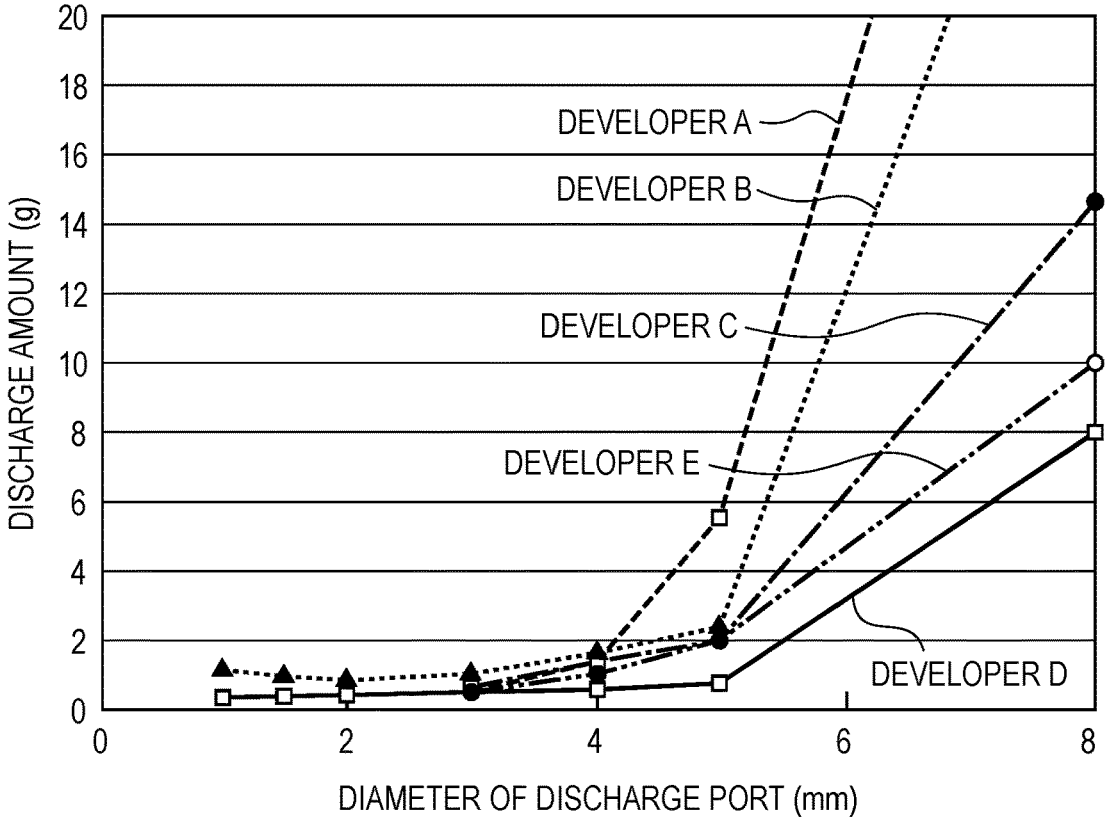
FIG. 9 is a graph illustrating a relationship between a diameter of a discharge port and a discharge amount.

For the developers having the measured fluid energy (Table 1), a result of the verification experiment is indicated in FIG. 9. FIG. 9 is a graph illustrating a relationship between the diameter of the discharge port and the discharge amount for each developer type. From a verification result illustrated in FIG. 9, it was confirmed that, for developers A-E, when the diameter ϕ of the discharge port is 4 mm (an opening area is 12.6 mm$^2$: calculated with a circular constant 3.14, the same applies hereinafter) or smaller, the discharge amount from the discharge port becomes 2 g or less. It was confirmed that, when the diameter ϕ of the discharge port becomes larger than 4 mm, the discharge amount suddenly increases for all the developers.

In other words, when the fluid energy (the bulk density is 0.5 g/cm$^2$) of the developer is equal to or larger than $4.3\times10^{-4}$ (kg·m$^2$/s$^2$ (J)) and is equal to or less than $4.14\times10^{-3}$ (kg·m$^2$/s$^2$ (J)), the diameter ϕ of the discharge port can be 4 mm (the opening area is 12.6 (mm$^2$)) or less.

For the bulk density of the developer, the measurement was conducted in the state that the developer was sufficiently loosened and fluidized in the verification experiment, the bulk density is lower than that in the state assumed in a normal using environment (the state of being left), and the measurement was conducted under the condition that it is easier to discharge the developer.

Figure 10:
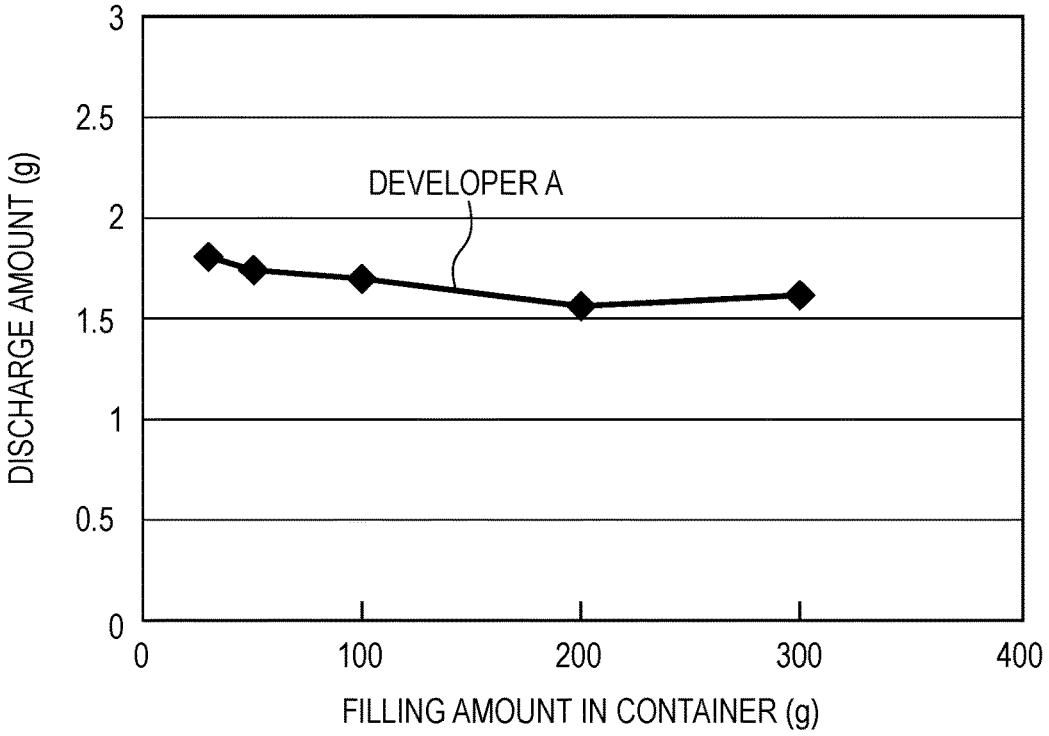
FIG. 10 is a graph illustrating a relationship between a filling amount in a container and the discharge amount.

A similar verification experiment was conducted using the developer A to be the largest discharge amount from the result in FIG. 9, fixing the diameter ϕ of the discharge port at 4 mm and changing the filling amount in the container between 30-300 g. The verification result is illustrated in FIG. 10. From the verification result shown in FIG. 10, it was confirmed that, even when the filling amount of the developer is changed, the discharge amount from the discharge port hardly changes.

From the above results, it was confirmed that, by setting the discharge port to ϕ 4 mm (the area 12.6 $mm^2$) or smaller, the developer is not sufficiently discharged from the discharge port only by the gravity action in the state of directing the discharge port downwards (assuming a replenishing posture to the developer replenishing apparatus 201) regardless of the developer type or a bulk density state.

A lower limit value of the size of the discharge port 4*a* can be set at such a value that the developer (the one-component magnetic toner, the one-component nonmagnetic toner, the two-component nonmagnetic toner, and the two-component magnetic carrier) to be replenished from the developer replenishing container 1 can at least pass through.

In other words, the discharge port can be larger than a particle diameter (a volume average particle diameter in the case of the toner and a number average particle diameter in the case of the carrier) of the developer contained in the developer replenishing container 1. For example, in the case that the two-component nonmagnetic toner and the two-component magnetic carrier are included in the developer for replenishment, the discharge port can be larger than the larger particle diameter, that is, the number average particle diameter of the two-component magnetic carrier.

Specifically, in the case that the two-component nonmagnetic toner (the volume average particle diameter is 5.5 μm) and the two-component magnetic carrier (the number average particle diameter is 40 μm) are included in the developer to be replenished, the diameter of the discharge port 4*a* can be set at 0.05 mm (the opening area 0.002 $mm^2$) or larger. However, when the size of the discharge port 4*a* is set at the size close to the particle diameter of the developer, energy needed to discharge a desired amount of the developer from the developer replenishing container 1, that is, the energy needed to operate the pump part 3*a*, becomes large.

In addition, limitation sometimes arises in terms of manufacturing of the developer replenishing container 1. In order to mold the discharge port 4*a* at a resin component using the injection molding method, durability of a die component to form the discharge port 4*a* becomes tight. From the above, the diameter ϕ of the discharge port 4*a* can be set at 0.5 mm or larger.

In the present embodiment, the shape of the discharge port 4*a* is a circular shape, however, it is not limited to such a shape. In other words, as long as it is an opening having the opening area of 12.6 $mm^2$ which is the opening area corresponding to the case that the diameter is 4 mm, it can be changed to a square, a rectangle, an ellipse, or a shape for which a straight line and a curve are combined. However, when the opening area is the same, the circular-shaped discharge port has the shortest peripheral length of the edge of the opening to be stained by the stuck developer compared to the other shapes. Therefore, an amount of the developer to spread in conjunction with the opening/closing operation of the shutter 4*b* is small and the discharge port is not easily stained.

For the circular-shaped discharge port, resistance during the discharge is little and discharge performance is the highest. Therefore, as the shape of the discharge port 4*a*, the circular shape with the most excellent balance between the discharge amount and stain prevention is more preferable. From the above, the size of the discharge port 4*a* can be such a size that the developer is not sufficiently discharged only by the gravity action in the state of directing the discharge port 4*a* vertically downwards (assuming the replenishing posture to the developer replenishing apparatus 201).

When a discharge experiment was conducted containing various developers in the developer replenishing container 1, the diameter ϕ of the discharge port 4*a* is preferable to set in a range of 0.05 mm (the opening area 0.002 $mm^2$) or larger and 4 mm (the opening area 12.6 $mm^2$) or smaller. Further, it was confirmed that it is more preferable to set the diameter ϕ of the discharge port 4*a* in a range of 0.5 mm (the opening area 0.2 $mm^2$) or larger and 4 mm (the opening area 12.6 $mm^2$) or smaller. In the present embodiment, from the above viewpoints, the discharge port 4*a* has the circular shape and the diameter ϕ of the opening is set at 2 mm.

In the present embodiment, the number of the discharge port 4*a* is one, but it is not limited thereto. The plurality of discharge ports 4*a* may be provided so that each discharge port 4*a* has opening area which satisfies the range of the opening area described above. For example, for one developer receiving port 13 of the diameter ϕ 3 mm, two discharge ports 4*a* of the diameter ϕ 0.7 mm may be provided. However, in this case, since the discharge amount (per unit time) of the developer tends to decrease, the configuration of providing one discharge port 4*a* of the diameter ϕ 2 mm is more preferable.

<Cylinder Part>

The cylinder part 2*k* that functions as the developer containing chamber will be described using FIGS. 7A, 7B and 7C. On an inner surface of the cylinder part 2*k*, the spirally projected conveyance projection 2*c*, that functions as a unit of conveying the contained developer toward the discharge part 4*c* (the discharge port 4*a*) which functions as the developer discharge chamber accompanying the rotation of itself, is provided. The cylinder part 2*k* is formed by the blow molding method using the resin of the above-described material.

When trying to increase the volume of the developer replenishing container 1 and increasing the filling amount, a method of increasing the volume of the discharge part 4*c* as the developer containing part 2 in a height direction is conceivable. However, when such a configuration is adopted, the gravity action to the developer in the vicinity of the discharge port 4*a* is increased by self-weight of the developer. As a result, the developer in the vicinity of the discharge port 4*a* is easily consolidated, to thereby obstruct suction/exhaust through the discharge port 4*a*. In this case, in order to loosen the consolidated developer by the suction from the discharge port 4*a* or to discharge the developer by the exhaust, a volume change amount of the pump part 3*a* needs to increase. As a result, driving force for driving the pump part 3*a* also increases and there is a risk for excessively increasing loads on the image forming apparatus main body 100.

In the present embodiment, the cylinder part 2*k* is installed next to the flange part 4 in a horizontal direction, and the filling amount is adjusted by the volume of the cylinder part 2*k*. Therefore, with respect to the above configuration, a thickness of the developer layer on the discharge port 4*a* in the developer replenishing container 1 can be set thin. Thus, the developer is not easily consolidated by the gravity action. As a result, the developer can be stably discharged without putting loads on the image forming apparatus main body 100.

The cylinder part 2*k* is relatively rotatably fixed to the flange part 4 in the state of compressing a flange seal 5*b* which is a ring-like seal member provided on an inner surface of the flange part 4, as illustrated in FIGS. 7B and 7C.

Thus, since the cylinder part 2*k* rotates while sliding with respect to the flange seal 5*b*, the developer does not leak during the rotation and the airtightness is maintained. In other words, air is appropriately made to go in and out through the discharge port 4*a*, and volume variation of the developer replenishing container 1 during the replenishment can be in a desired state.

<Pump Part>

The pump part 3*a* (capable of reciprocating) whose volume is variable accompanying reciprocation will be described using FIGS. 7A, 7B and 7C. FIG. 7A is a sectional perspective view of the developer replenishing container, FIG. 7B is a partial sectional view of a state that the pump part 3*a* is maximally expanded for use, and FIG. 7C is a partial sectional view of a state that the pump part 3*a* is maximally contracted for use.

The pump part 3*a* of the present embodiment functions as a suction and exhaust mechanism that alternately performs a suction operation and an exhaust operation through the discharge port 4*a*. In other words, the pump part 3*a* functions as an air flow generation mechanism that alternately and repeatedly generates an air flow toward the inside of the developer replenishing container and an air flow toward the outside from the developer replenishing container through the discharge port 4*a*.

The pump part 3*a* is provided in the direction of the arrow X from the discharge part 4*c* as illustrated in FIG. 7B. That is, the pump part 3*a* is provided so as not to rotate by itself in the rotation direction of the cylinder part 2*k* together with the discharge part 4*c*.

The pump part 3*a* of the present embodiment can contain the developer in the inside. A developer containing space in the pump part 3*a* plays a large role in fluidization of the developer during the suction operation.

In the present embodiment, as the pump part 3*a*, a resin-made volume variable type pump part (bellows-shaped pump) whose volume is variable accompanying the reciprocation is adopted. Specifically, as illustrated in FIGS. 7A, 7B and 7C, a bellows-shaped pump is adopted, and a plurality of "mountain fold" parts and a plurality of "valley fold" parts are cyclically and alternately formed. Thus, the pump part 3*a* can be alternately and repeatedly compressed and expanded by the driving force received from the developer replenishing apparatus 201. In the present embodiment, the volume change amount when the pump part 3*a* is expanded and contracted is set at 5 $cm^3$ (cc). L3 illustrated in FIG. 7B is about 29 mm, and L4 illustrated in FIG. 7C is about 24 mm. An outer diameter R2 of the pump part 3*a* is about 45 mm.

By adopting the pump part 3*a*, the volume of the developer replenishing container 1 can be varied and can be alternately and repeatedly changed in a predetermined cycle. As a result, the developer in the discharge part 4*c* can be efficiently discharged from the discharge port 4*a* having the small diameter (the diameter is about 2 mm).

<Drive Input Part>

The drive input part of the developer replenishing container 1 that receives the rotary driving force for rotating the cylinder part 2*k* including the conveyance projection 2*c* from the developer replenishing apparatus 201 will be described.

The developer replenishing container 1 is provided with a gear part 2*d* that functions as the drive input part capable of being engaged (drive-connected) with the drive gear 300 (functioning as the drive mechanism) of the developer replenishing apparatus 201, as illustrated in FIG. 6A. The gear part 2*d* is integrally rotatable with the cylinder part 2*k*.

Figure 11A:
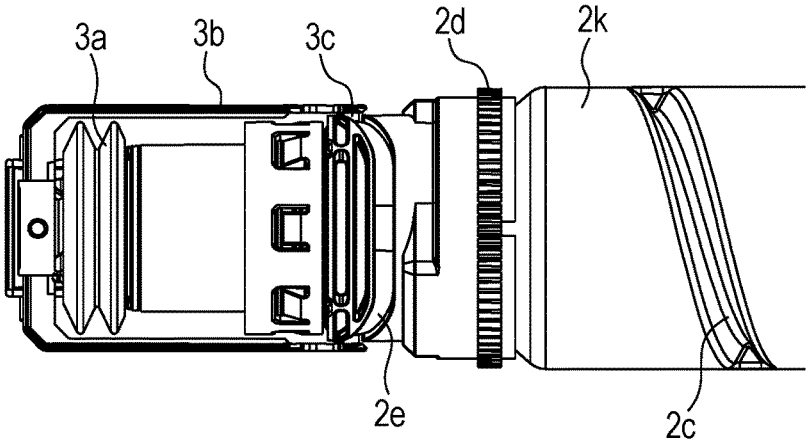
FIG. 11A is a partial view of the state that the pump part is maximally expanded for use.
Figure 11B:
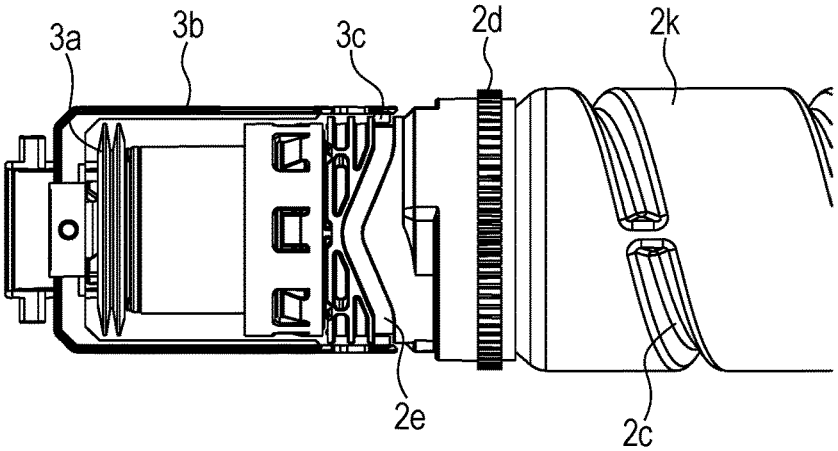
FIG. 11B is a partial view of the state that the pump part is maximally contracted for use.

Therefore, the rotary driving force input from the drive gear 300 to the gear part 2*d* is transmitted to the pump part 3*a* through a reciprocating member 3*b* in FIGS. 11A and 11B. The bellows-shaped pump part 3*a* of the present embodiment is manufactured using a resin material having a characteristic of being strong against twisting in the rotation direction within the range of not obstructing the expansion/contraction operation.

In the present embodiment, the gear part 2*d* is provided on the longitudinal direction (developer conveyance direction) side of the cylinder part 2*k*, however, it is not limited to such an example. For example, the gear part 2*d* may be provided on the other end side in the longitudinal direction, that is, the rearmost side, of the developer containing part 2. In this case, the drive gear 300 is installed at a corresponding position.

In the present embodiment, a gear mechanism is used as a drive connection mechanism between the drive input part of the developer replenishing container 1 and the drive part of the developer replenishing apparatus 201, however, it is not limited to such an example. For example, a known coupling mechanism may be used. Specifically, a non-circular recess may be provided as the drive input part, a projection having a shape corresponding to the recess may be provided as the drive part of the developer replenishing apparatus 201, and the recess and the projection may be drive-connected to each other.

<Drive Conversion Mechanism>

Figure 11C:
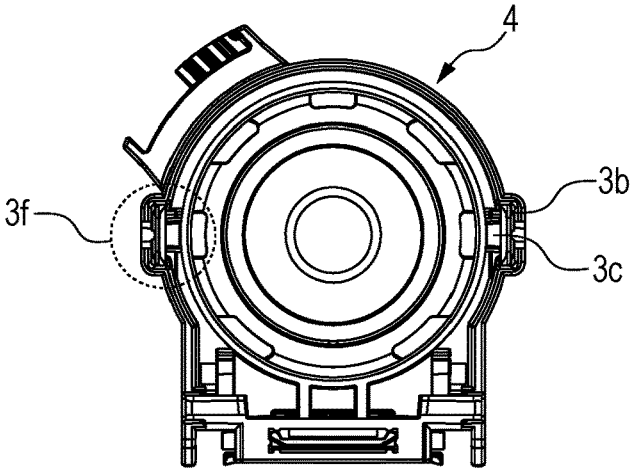
FIG. 11C is a partial view of the pump part.

The drive conversion mechanism (drive conversion part) of the developer replenishing container 1 will be described using FIGS. 11A, 11B and 11C. FIG. 11A is a partial view of the state that the pump part 3*a* is maximally expanded for use, FIG. 11B is a partial view of the state that the pump part 3*a* is maximally contracted for use, and FIG. 11C is a partial view of the pump part. In the present embodiment, the case of using a cam mechanism will be described as an example of the drive conversion mechanism.

As illustrated in FIG. 11A, the developer replenishing container 1 is provided with the cam mechanism that functions as the drive conversion mechanism (drive conversion part) which converts the rotary driving force for rotating the cylinder part 2*k* received by the gear part 2*d* to force in a direction of reciprocating the pump part 3*a*.

In the present embodiment, by converting the rotary driving force received by the gear part 2*d* to reciprocating force on the side of the developer replenishing container 1, the driving force for rotating the cylinder part 2*k* and the driving force for reciprocating the pump part 3*a* are received by one drive input part (the gear part 2*d*).

Thus, compared to the case of providing two drive input parts separately in the developer replenishing container 1, the configuration of the drive input mechanism of the developer replenishing container 1 can be simplified. Further, since the configuration of receiving drive from one drive gear of the developer replenishing apparatus 201 is adopted, it can contribute also to the simplification of the drive mechanism of the developer replenishing apparatus 201.

As illustrated in FIGS. 11A and 11B, the reciprocating member 3*b* is used as a member interposed in order to convert the rotary driving force to the reciprocating force of the pump part 3*a*. Specifically, a cam groove 2*e* provided with a groove on the entire periphery united with the drive input part (the gear part 2*d*) which receives rotary drive from the drive gear 300 rotates. The cam groove 2*e* will be described later. For the cam groove 2*e*, reciprocating member engaging projections 3*c* partially projected from the reciprocating member 3*b* are engaged with the cam groove 2*e*. In the present embodiment, for the reciprocating member 3*b*, as illustrated in FIG. 11C, the rotation direction of the cylinder part 2*k* is regulated by a protective member rotation regulating part 3*f* so as not to rotate by itself in the rotation direction of the cylinder part 2*k* (movements such as backlash are allowed). In such a manner, by regulating the rotation direction, it is regulated to reciprocate (in the X direction in FIGS. 7B and 7C or the opposite direction) along the groove of the cam groove 2*e*. The plurality of reciprocating member engaging projections 3*c* is provided so as to be engaged with the cam groove 2*e*. Specifically, two reciprocating member engaging projections 3*c* are provided on an outer peripheral surface of the cylinder part 2*k* so as to be opposite each other at about 180°.

For the number of the reciprocating member engaging projections 3*c* to be arranged, at least one may be provided. However, since there is a risk that moment is generated in the drive conversion mechanism or the like by reaction when the pump part 3*a* is expanded or contracted and smooth reciprocation is not performed, two or more projections may be provided so as not to destroy a relationship with the shape of the cam groove 2*e*.

By rotating the cam groove 2*e* by the rotary driving force input from the drive gear 300, the reciprocating member engaging projections 3*c* perform a reciprocating operation in the X direction or the opposite direction along the cam groove 2*e*. Thus, the state that the pump part 3*a* is expanded (FIG. 11A) and the state that the pump part 3*a* is contracted (FIG. 11B) are alternately repeated, and the volume variation of the developer replenishing container 1 can be achieved.

<Setting Condition of Drive Conversion Mechanism>

In the present embodiment, the drive conversion mechanism converts the drive so that a developer conveyance amount (per unit time) to be conveyed to the discharge part 4*c* accompanying the rotation of the cylinder part 2*k* becomes larger than the amount (per unit time) to be discharged from the discharge part 4*c* to the developer replenishing apparatus 201 by the action of the pump part.

This is because that, when a developer discharge capacity by the pump part 3*a* is greater than a developer conveyance capacity by the conveyance projection 2*c* to the discharge part 4*c*, the amount of the developer present in the discharge part 4*c* gradually decreases. In other words, it is for preventing the time needed for replenishing the developer from the developer replenishing container 1 to the developer replenishing apparatus 201 from lengthening.

In the present embodiment, the drive conversion mechanism converts the drive such that the pump part 3*a* reciprocates for multiple times while the cylinder part 2*k* rotates once. This is because of the following reason.

In the case of the configuration of rotating the cylinder part 2*k* in the developer replenishing apparatus 201, required output of the drive motor 500 can be set for rotating the cylinder part 2*k* stably at all times. However, in order to reduce energy consumption in the image forming apparatus main body 100 as much as possible, the output of the drive motor 500 can be reduced as much as possible. Here, since the output required for the drive motor 500 is calculated from the rotary torque and the number of the rotation of the cylinder part 2*k*, in order to reduce the output of the drive motor 500, the number of the rotation of the cylinder part 2*k* can be set as low as possible.

In the case of the present embodiment, when the number of the rotation of the cylinder part 2*k* is reduced, the number of times of the operations of the pump part 3*a* per unit time is reduced. Therefore, the amount (per unit time) of the developer discharged from the developer replenishing container 1 is reduced. That is, there is a risk that the amount of the developer discharged from the developer replenishing container 1 is insufficient in order to satisfy a developer replenishing amount demanded from the image forming apparatus main body 100 in a short time.

When the volume change amount of the pump part 3*a* is increased, the developer discharge amount per cycle of the pump part 3*a* can be increased. Therefore, the demand from the image forming apparatus main body 100 can be met, however, there is the following problem in such a coping method.

That is, when the volume change amount of the pump part 3*a* is increased, a peak value of an internal pressure (positive pressure) of the developer replenishing container 1 in an exhaust process becomes large. Therefore, the load needed for reciprocating the pump part 3*a* increases.

For such a reason, in the present embodiment, the pump part 3*a* is operated for a plurality of cycles while the cylinder part 2*k* rotates once. Thus, compared to the case of operating the pump part 3*a* only for one cycle while the cylinder part 2*k* rotates once, the developer discharge amount per unit time can be increased without increasing the volume change amount of the pump part 3*a*. Since the developer discharge amount can be increased, the number of rotations of the cylinder part 2*k* can be reduced.

By the configuration as in the present embodiment, the output of the drive motor 500 can be set to be smaller. Therefore, contribution can be made in reduction of the energy consumption in the image forming apparatus main body 100.

<Arrangement Position of the Drive Conversion Mechanism>

In the present embodiment, as illustrated in FIGS. 11A, 11B and 11C, the drive conversion mechanism (the cam mechanism including the reciprocating member engaging projections 3*c* and the cam groove 2*e*) is provided outside the developer containing part 2. That is, the drive conversion mechanism is provided on a position isolated from the internal space of the cylinder part 2*k*, the pump part 3*a* and the discharge part 4*c* so as not to be in contact with the developer contained in the cylinder part 2*k*, the pump part 3*a* and the discharge part 4*c*.

Thus, problems to be assumed in the case of providing the drive conversion mechanism in the internal space of the developer containing part 2 can be dissolved. In other words, the situation that particles of the developer are softened by application of heat and a pressure and some particles are stuck to each other and become a large lump (coarse particle) due to invasion of the developer into a sliding part of the drive conversion mechanism and torque-up due to biting of the developer into the conversion mechanism can be prevented.

<Developer Replenishing Process>

Figure 12:
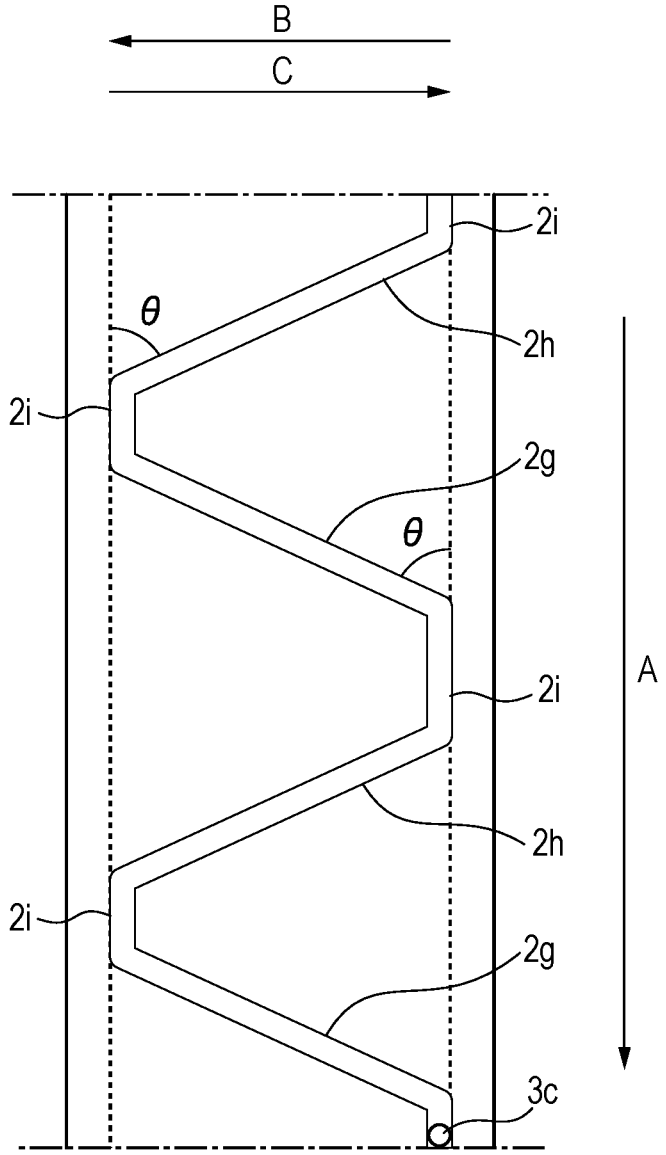
FIG. 12 is a development view illustrating a cam groove shape of the developer replenishing container.

Using FIGS. 11A, 11B and 11C and FIG. 12, the developer replenishing process by the pump part 3*a* will be described. FIG. 11A is a partial view of the state that the pump part 3*a* is maximally expanded for use, FIG. 11B is a partial view of the state that the pump part 3*a* is maximally contracted for use, and FIG. 11C is a partial view of the pump part 3*a*. FIG. 12 is a development view of the cam groove 2*e* in the drive conversion mechanism (the cam mechanism including the reciprocating member engaging projections 3*c* and the cam groove 2*e*).

In the present embodiment, a suction process (the suction operation through the discharge port 4*a*) and an exhaust process (the exhaust operation through the discharge port 4*a*) by the operation of the pump part and an operation stop process (no suction or exhaust is performed through the discharge port 4*a*) due to the non-operation of the pump part are performed. At the time, the drive conversion mechanism converts the rotary driving force to the reciprocating force. Hereinafter, the suction process, the exhaust process and the operation stop process will be described in details in order.

<Suction Process>

The suction process (the suction operation through the discharge port 4*a*) will be described.

The suction operation is performed by the change from the state that the pump part 3*a* is maximally contracted in FIG. 11B to the state that the pump part 3*a* is maximally expanded in FIG. 11A by the drive conversion mechanism (cam mechanism). Accompanying the suction operation, the volume of parts (the pump part 3*a*, the cylinder part 2*k* and the discharge part 4*c*) capable of containing the developer in the developer replenishing container 1 increases.

At the time, the inside of the developer replenishing container 1 is practically sealed except for the discharge port 4*a*, and the discharge port 4*a* is practically blocked by the developer. Therefore, as the volume of the parts capable of containing the developer in the developer replenishing container 1 increases, the internal pressure of the developer replenishing container 1 decreases.

At the time, the internal pressure of the developer replenishing container 1 becomes lower than an atmospheric pressure (outside pressure). Therefore, air that exists outside the developer replenishing container 1 moves through the discharge port 4*a* into the developer replenishing container 1 due to a pressure difference between the inside and outside of the developer replenishing container 1.

At the time, since the air is taken from the outside of the developer replenishing container 1 through the discharge port 4*a*, the developer positioned in a vicinity of the discharge port 4*a* can be loosened (fluidized). Specifically, by making the developer positioned in the vicinity of the discharge port 4*a* contain the air, the bulk density is decreased, and the developer can be appropriately fluidized.

At the time, since the air is taken into the developer replenishing container 1 through the discharge port 4*a*, the internal pressure of the developer replenishing container 1 changes near the atmospheric pressure (outside pressure) even though the volume increases.

By fluidizing the developer, the developer is not stuck at the discharge port 4*a* upon the exhaust operation and the developer can be smoothly discharged from the discharge port 4*a*. Thus, the amount (per unit time) of the developer discharged from the discharge port 4*a* can be almost fixed over a long period of time.

Without being limited to the change from the most contracted state to the most expanded state of the pump part 3*a* to perform the suction operation, even if the pump part 3*a* is stopped in the middle of changing from the most contracted state to the most expanded state, the suction operation is performed when the internal pressure of the developer replenishing container 1 is changed. In other words, the suction process is the state that the reciprocating member engaging projections 3*c* are engaged with cam grooves 2*h* illustrated in FIG. 12.

<Exhaust Process>

The exhaust process (the exhaust operation through the discharge port 4*a*) will be described. The exhaust operation is performed by the change from the state that the pump part 3*a* is maximally expanded in FIG. 11A to the state that the pump part 3*a* is maximally contracted in FIG. 11B. Specifically, the volume of the parts (the pump part 3*a*, the cylinder part 2*k* and the discharge part 4*c*) capable of containing the developer in the developer replenishing container 1 decreases accompanying the exhaust operation. At the time, the inside of the developer replenishing container 1 is practically sealed except for the discharge port 4*a*, and the discharge port 4*a* is practically blocked by the developer until the developer is discharged. Thus, by the decrease of the volume of the parts capable of containing the developer in the developer replenishing container 1, the internal pressure of the developer replenishing container 1 rises.

At the time, since the internal pressure of the developer replenishing container 1 becomes higher than the atmospheric pressure (outside pressure), the developer is extruded from the discharge port 4*a* by the pressure difference between the inside and outside of the developer replenishing container 1. That is, the developer is discharged from the developer replenishing container 1 to the developer replenishing apparatus 201.

Since the air in the developer replenishing container 1 is also discharged together with the developer, the internal pressure of the developer replenishing container 1 lowers.

As described above, in the present embodiment, since the developer can be efficiently discharged using one reciprocating type pump part 3*a*, a mechanism needed for developer discharge can be simplified.

Without being limited to the change from the most expanded state to the most contracted state of the pump part 3*a* to perform the exhaust operation, even if the pump part 3*a* is stopped in the middle of changing from the most expanded state to the most contracted state, the exhaust operation is performed when the internal pressure of the developer replenishing container 1 is changed. In other words, the exhaust process is the state that the reciprocating member engaging projections 3*c* are engaged with cam grooves 2*g* illustrated in FIG. 12.

<Operation Stop Process>

The operation stop process in which the pump part 3*a* does not reciprocate will be described.

In the present embodiment, the control device 600 controls the operation of the drive motor 500 based on the detection result of the magnetic sensor 800*c* or the developer sensor 10*d*. In this configuration, since the developer amount discharged from the developer replenishing container 1 directly affects the toner density, the developer amount required by the image forming apparatus needs to be replenished from the developer replenishing container 1. At the time, in order to stabilize the developer amount discharged from the developer replenishing container 1, a fixed volume variation amount can be performed every time.

For example, when the cam groove 2*e* configured only by an exhaust process portion and a suction process portion is adopted, motor drive must be stopped in the middle of the exhaust process or the suction process. At the time, even after the rotation of the drive motor 500 is stopped, the cylinder part 2*k* rotates inertially, the pump part 3*a* also continuously reciprocates in linkage until the cylinder part 2*k* stops, and the exhaust process or the suction process is performed. A distance that the cylinder part 2*k* inertially rotates depends on a rotation speed of the cylinder part 2*k*. The rotation speed of the cylinder part 2*k* depends on the torque given to the drive motor 500. From this fact, since there is a possibility that the torque to the motor changes depending on the developer amount in the developer replenishing container 1 and the speed of the cylinder part 2*k* also changes, it is difficult to make a stop position of the pump part 3*a* be the same every time.

In order to stop the pump part 3*a* at the same position every time, it is needed to provide the cam groove 2*e* with an area where the pump part 3*a* does not reciprocate even the cylinder part 2*k* during the rotating operation. At the cam groove 2*e* of the present embodiment, as illustrated in FIG. 12, first cam grooves 2*g* inclined at a predetermined angle θ with respect to the rotation direction (the direction of an arrow A) of the cylinder part 2*k* and second cam grooves 2*h* inclined symmetrically to the first cam grooves 2*g* are alternately and repeatedly provided. When the reciprocating member engaging projections 3*c* are engaged with the rotating first cam grooves 2*g*, the pump part 3*a* is expanded in the direction of an arrow B to be the suction process, and when the reciprocating member engaging projections 3*c* are engaged with the second cam grooves 2*h*, the pump part 3*a* is compressed in the direction of an arrow C to be the exhaust process.

In the present embodiment, third cam grooves 2*i* substantially parallel to the rotation direction (the direction of the arrow A) are provided so as to connect the first cam grooves 2*g* and the second cam grooves 2*h*. The cam grooves 2*i* have such a shape that the reciprocating member 3*b* do not move even when the cylinder part 2*k* rotates. In other words, the operation stop process is the state that the reciprocating member engaging projections 3*c* are engaged with the cam grooves 2*i*.

"The pump part 3*a* does not reciprocate" results in that the developer is not discharged from the discharge port 4*a* (allowing the developer that falls off from the discharge port 4*a* due to vibrations or the like when the cylinder part 2*k* rotates). That is, as long as the exhaust process and the suction process through the discharge port 4*a* are not performed, the cam grooves 2*i* may be inclined to the rotating shaft direction with respect to the rotation direction. Since the cam grooves 2*i* are inclined, the reciprocating operation for the inclination of the pump part 3*a* can be allowed.

<Displacement Part>

The configuration of a displacement part 12 which is the most characteristic configuration of the present invention will be described using FIG. 13 to FIG. 17.

Figure 14A:
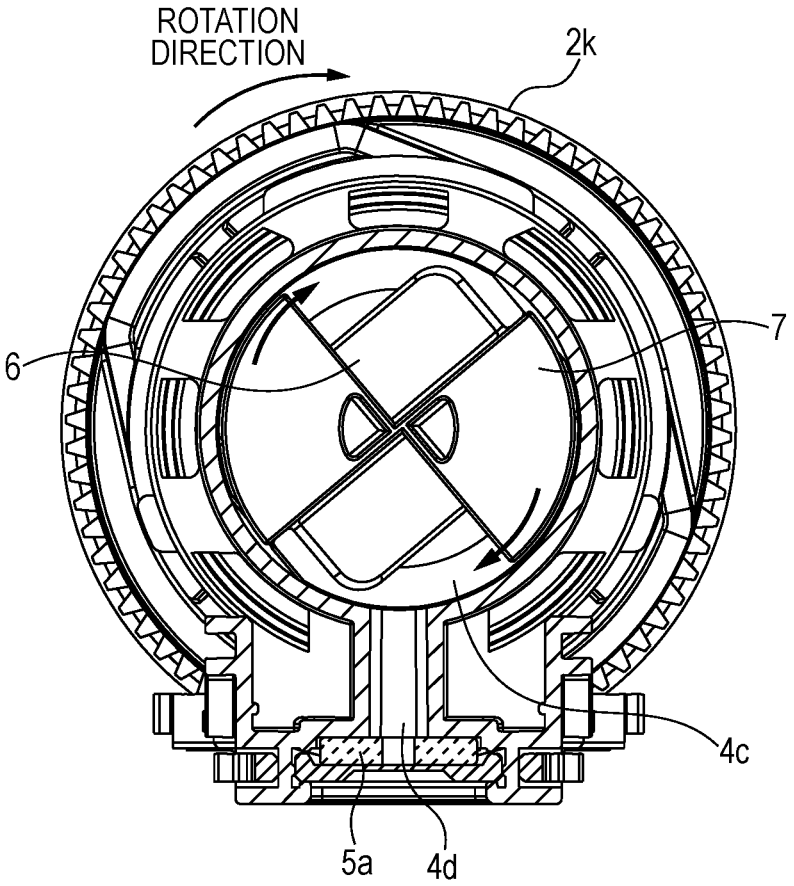
FIG. 14A is a partial sectional view in a comparative example.
Figure 14B:
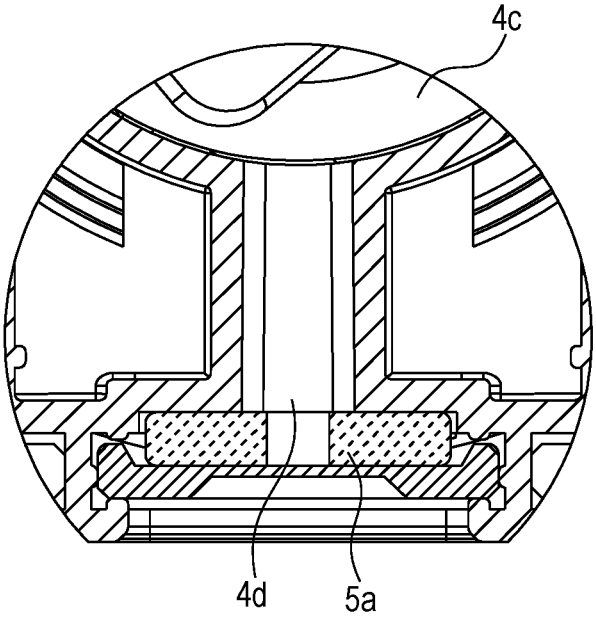
FIG. 14B is a detailed partial sectional view of a vicinity of the developer storage part in the comparative example.
Figure 15A:
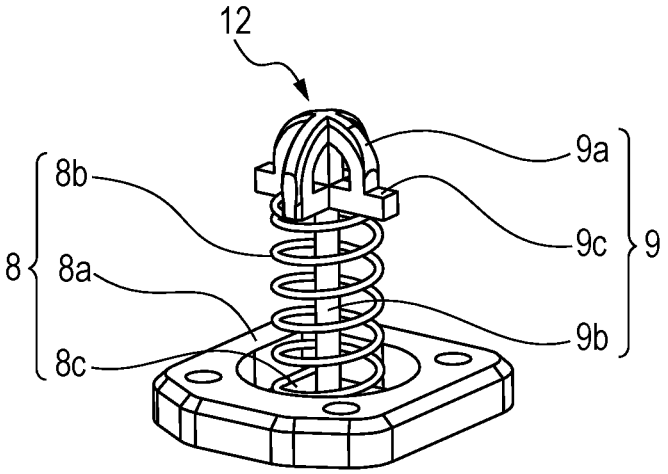
FIG. 15A is a perspective view of a displacement part.
Figure 15B:
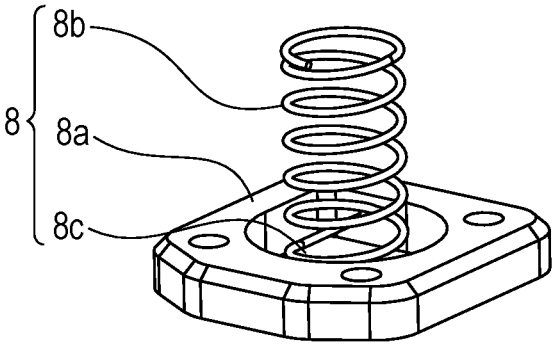
FIG. 15B is a perspective view of a coil spring unit.
Figure 15C:
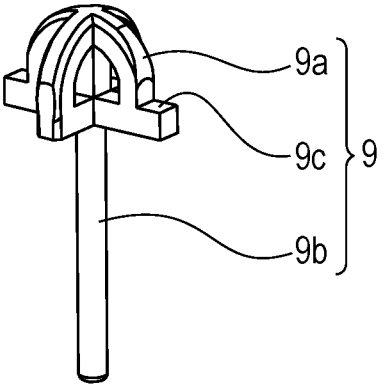
FIG. 15C is a perspective view of a shaft member.

FIGS. 13A and 13B and FIGS. 16A and 16B are partial sectional views of the developer replenishing container 1 and detailed partial sectional views of the vicinity of the developer storage part 4*d* according to the present embodiment. FIGS. 14A and 14B are a partial sectional view of the developer replenishing container and a detailed partial sectional view of the vicinity of the developer storage part 4*d* relating to a comparative example. FIG. 15A is a perspective view of the displacement part 12, FIG. 15B is a perspective view of a coil spring unit 8, and FIG. 15C is a perspective view of a shaft member 9. FIGS. 17A, 17B and 17C are perspective views illustrating an assembly process of the displacement part 12.

Figure 13A:
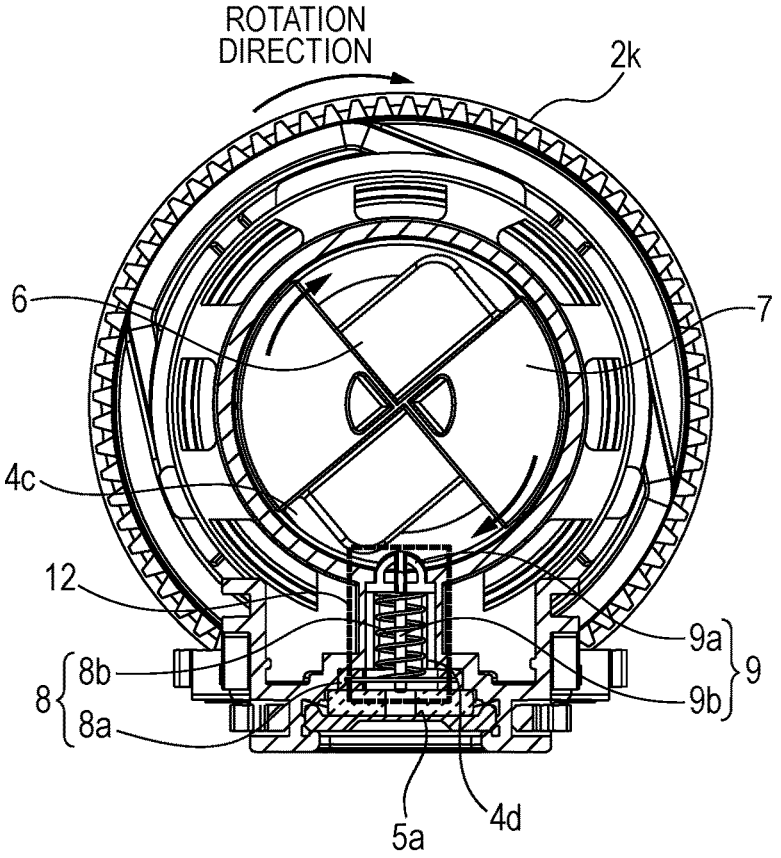
FIG. 13A is a partial sectional view of the developer replenishing container.
Figure 13B:
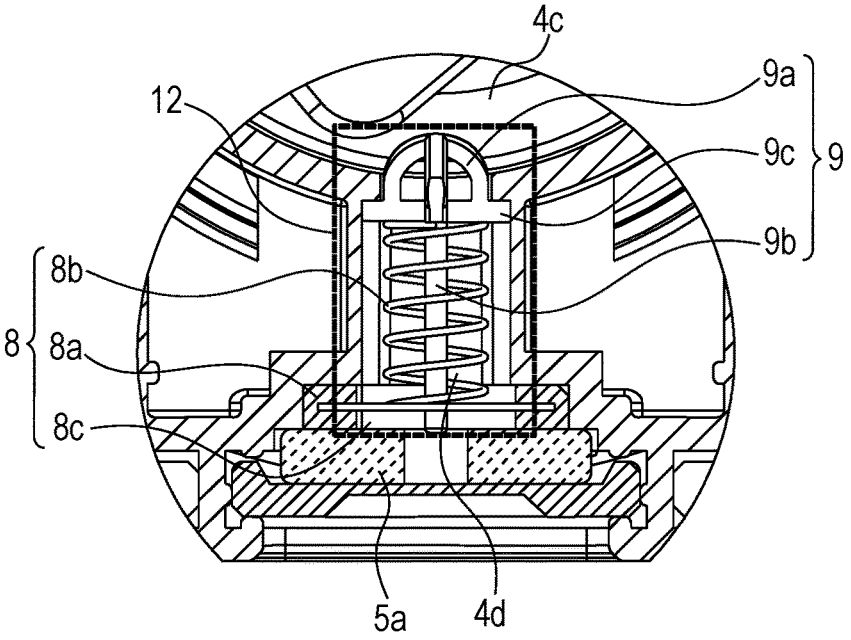
FIG. 13B is a detailed partial sectional view of a vicinity of a developer storage part.

The present embodiment is, as illustrated in FIGS. 13A and 13B, provided with the displacement part 12 in the developer storage part 4*d*. Each comparative example illustrated in FIGS. 14A and 14B is not provided with the displacement part 12.

The displacement part 12 is displaceable in the developer in the vicinity of the discharge port in conjunction with the rotation of the conveyance member 6, and dissolves aggregation of the developer in the vicinity of the discharge port. The displacement part 12 of the present embodiment includes, as illustrated in FIGS. 13A and 13B and FIG. 15A, the coil spring unit 8 as a biasing member and the shaft member 9 as a moving member. As illustrated in FIG. 15B, for the coil spring unit 8, two components which are a spring plate 8*a* including a communication port 8*c*, through which the developer can pass, and a coil spring 8*b* are integrally insertion-molded and made into a unit. The shaft member 9 includes, as illustrated in FIGS. 13A and 13B and FIG. 15C, a contact part 9*a* provided so as to be contactable with the conveyance member 6, and a shaft part 9*b* provided inside the coil spring 8*b*.

For the coil spring unit 8, in the present embodiment, the spring plate 8*a* and the coil spring 8*b* are made into a unit by insertion molding, however, it is not limited thereto. However, in consideration of the assembly process of the displacement part 12, assembly can be simple for the configuration with a less number of components.

An object of providing the displacement part 12 is to dissolve the aggregation of the developer by an extremely simple configuration and compatibly provide an easily assemblable configuration.

An operation process for dissolving the aggregation of the developer in the displacement part 12 will be specifically described.

In the present embodiment, even when a strong impact is continuously received during physical distribution, the bulk density of the developer in the developer storage part 4*d* rises and the developer is in the aggregated state, the developer can be surely and stably discharged regardless of physical distribution influence. The developer in the developer containing part 2 in a vicinity of an upper part of the developer storage part 4*d* is, even though it is in the aggregated state, destroyed by mixing of the conveyance member 6 or the regulating part 7. Therefore, in the following description, the aggregation of the developer in the developer storage part 4*d* will be described.

The operation process of the displacement part 12 will be described. FIGS. 13A and 13B illustrate the state (non-contact state) that the contact part 9*a* provided in the shaft member 9 is not in contact with the regulating part 7 provided on the conveyance member 6 rotatable accompanying the rotation of the cylinder part 2*k*.

As illustrated in FIGS. 13A and 13B, the shaft member 9 is installed above the compressed coil spring 8*b*, and is provided with a contact rib 9*c* that is contactable with the discharge part 4*c*. The shaft member 9 is regulated so as to be pressed vertically upwards against the discharge part 4*c* by the coil spring 8*b* and the contact rib 9*c*. As a result, the contact part 9*a* provided in the shaft member 9 is projected into the discharge part 4*c*.

The coil spring 8*b* used in the present embodiment is a compression coil spring, and is installed in the state of being compressed from a natural length in the state of FIGS. 13A and 13B. The coil spring 8*b* in the present embodiment is not to be compressed exceeding a closed height, is expandable and contractible in a compressible range from the natural length, and is used in a range that a spring characteristic can be semipermanently secured. Thus, by restoration force against the compression of the coil spring 8*b*, the shaft member 9 is always pressed vertically upwards.

Thus, in the state that the contact part 9*a* of the shaft member 9 is not in contact with the regulating part 7 of the conveyance member 6, the contact part 9*a* is always projected into the discharge part 4*c*.

A contact state that the contact part 9*a* of the shaft member 9 is in contact with the conveyance member 6 will be described using FIGS. 16A and 16B.

Figure 16A:
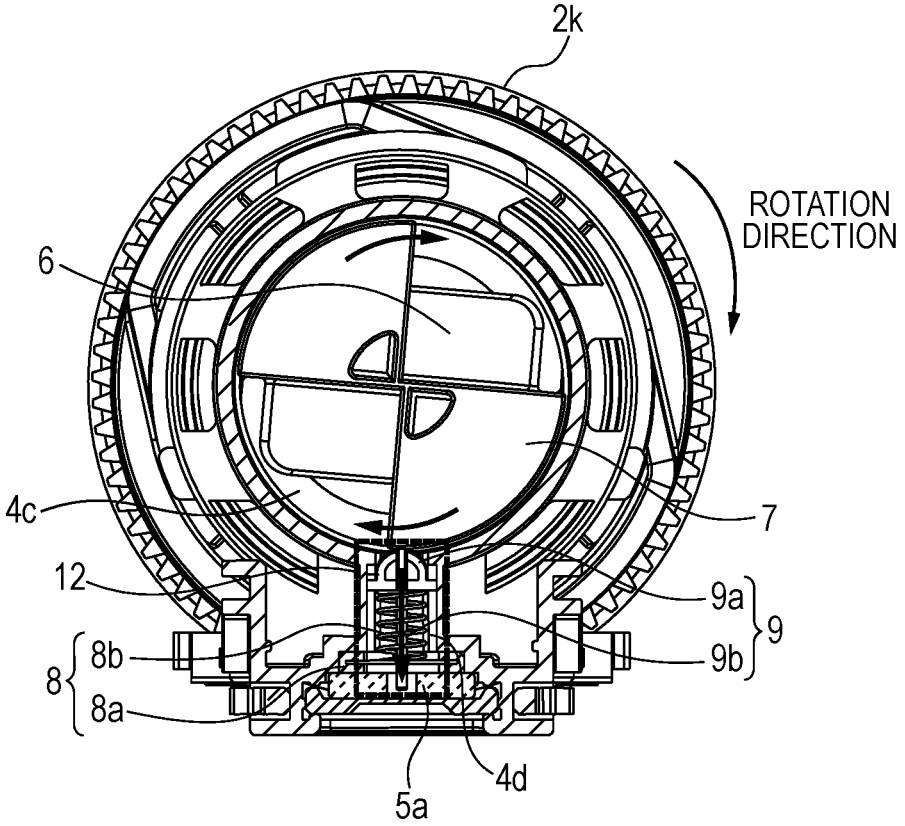
FIG. 16A is a partial sectional view of the developer replenishing container.
Figure 16B:
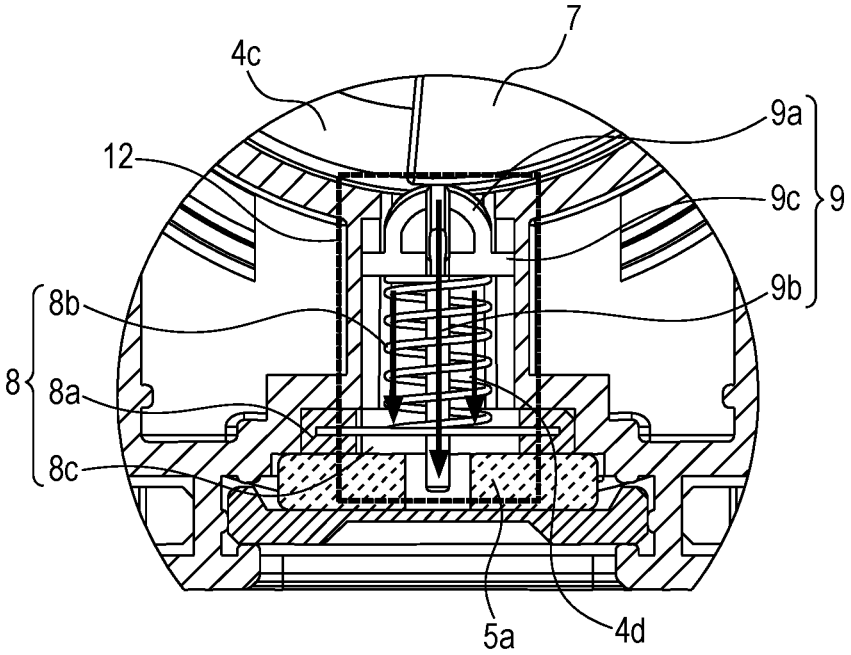
FIG. 16B is a detailed partial sectional view of a vicinity of the developer storage part.
Figure 17A:
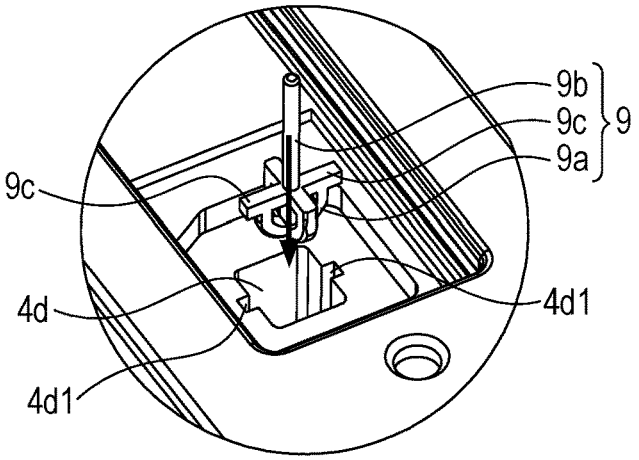
FIG. 17A is a perspective view illustrating an assembly process of the displacement part.
Figure 17B:
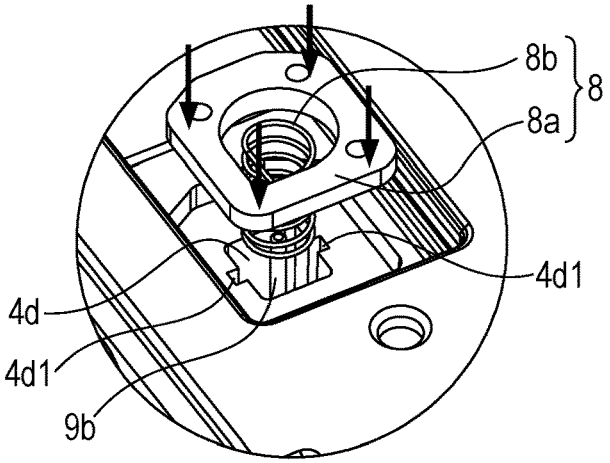
FIG. 17B is a perspective view illustrating an assembly process of the displacement part.
Figure 17C:
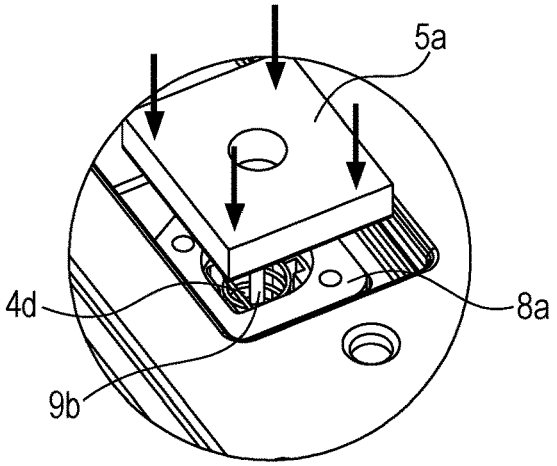
FIG. 17C is a perspective view illustrating an assembly process of the displacement part.

FIGS. 16A and 16B illustrate a state (contact state) in which the conveyance member 6 rotates accompanying the rotation of the cylinder part 2*k*, and the contact part 9*a* of the shaft member 9 is brought into contact with an arc-shaped part of the regulating part 7 provided in the conveyance member 6.

In the contact state, in contrast with the non-contact state in FIGS. 13A and 13B, the contact part 9*a* is pushed into the developer storage part 4*d*. Thus, the shaft member 9 is moved vertically downwards, and the coil spring 8*b* is also compressed further vertically downwards accompanying the movement.

By moving the shaft part 9*b* of the shaft member 9 arranged inside the coil spring 8*b* vertically downwards, a lower end of the shaft part 9*b* enters into an opening seal 5*a*. Therefore, by the movement of the shaft member 9 in the contact state, the shaft member 9 can physically act on the developer from an upper part to a lower part in the developer storage part 4*d*.

Thereafter, by the rotation of the conveyance member 6, the contact part 9*a* and the regulating part 7 are changed from the contact state to the non-contact state. Thus, by the restoration force of the compressed coil spring 8*b*, the coil spring 8*b* and the shaft member 9 move vertically upwards and return to the non-contact state illustrated in FIGS. 13A and 13B.

In the present embodiment, the contact state and the non-contact state of the contact part 9*a* and the conveyance member 6 are repeated by the rotation of the conveyance member 6 accompanying the rotation of the developer replenishing container 1. The coil spring 8*b* and the shaft member 9 can repeatedly reciprocate in vertical upper and lower directions in the developer storage part.

In a relationship between the displacement part 12 and the developer storage part 4*d*, as illustrated in FIGS. 13A and 13B and FIGS. 16A and 16B, the coil spring 8*b* reciprocates in a vicinity of an inner wall of the developer storage part 4*d*. The shaft member 9 reciprocates in a vicinity of the center of the developer storage part 4*d*. As a result, the displacement part 12 of the present embodiment including the coil spring 8*b* and the shaft member 9 can repeatedly exert physical action to the entire developer in the developer storage part 4*d* by the reciprocation in the vertical upper and lower directions.

Thus, by adopting the displacement part 12 of the present embodiment, even in the case that the developer in the developer storage part 4*d* is aggregated, by the displacement part 12 repeatedly exerting the physical action to the aggregated developer, the aggregation of the developer can be surely dissolved.

In the present embodiment, by the coil spring 8*b* acting on the developer in a vicinity of the inner wall of the developer storage part 4*d* and the shaft member 9 acting on the developer in a vicinity of the center of the developer storage part 4*d*, the aggregation of the developer in the entire developer storage part 4*d* can be dissolved.

If only the coil spring 8*b* is provided, the physical action cannot be exerted to the developer in a vicinity of the center of the developer storage part 4*d*, in the opening seal 5*a* provided in the lower part, or in the discharge port 4*a*, and there may be a possibility that the aggregation of the entire developer storage part 4*d* cannot be effectively dissolved.

If only the shaft member 9 is provided, when a shaft diameter of the shaft part 9*b* of the shaft member 9 is small in contrast with the size of the developer storage part 4*d*, there may be a possibility that the aggregation of the developer cannot be effectively dissolved in the vicinity of the inner wall of the developer storage part 4*d*.

On the contrary, the case that the shaft diameter of the shaft part 9*b* of the shaft member 9 is increased until it acts on the entire developer storage part 4*d*. In this case, though the aggregation of the developer can be dissolved, since the entire developer storage part 4*d* where the developer passes through toward the discharge part 4*c* is blocked in the first place, there may be a possibility that a desired replenishing amount cannot be supplied to the developer replenishing apparatus 201.

In contrast, since the displacement part 12 of the present embodiment is provided with the coil spring 8*b* and the shaft member 9 respectively acting on the vicinity of the inner wall and the vicinity of the center of the developer storage part 4*d*, the entire developer in the developer storage part 4*d* can be broken and the desired replenishing amount can be stably obtained.

A pitch of the coil spring 8*b* in the present embodiment is 1.5 mm, a wire diameter is ϕ 0.32, a spring constant is 0.21 N/mm, and a shaft diameter of the shaft part 9*b* of the shaft member 9 is ϕ 1.0, however, they are not limited thereto. According to caliber or the like of the developer storage part 4*d* and the discharge part 4*c* corresponding to the desired replenishing amount, the displacement part 12 can be designed with similar design ideas.

In the present embodiment, when comparing to the volume of the developer storage part 4*d* in the comparative example not provided with the displacement part 12 illustrated in FIGS. 14A and 14B, an occupancy rate of the displacement part 12 is about 20%. Thus, in the case of setting the replenishing amount from the developer replenishing container 1 of the present embodiment at the desired replenishing amount, it is desirable to consider the occupancy rate of the displacement part 12 in the developer storage part 4*d*, set the volume of the developer storage part 4*d*, and perform designing.

<Assembly Process of Displacement Part>

An assembly process for assembling the displacement part 12 into the developer replenishing container 1 will be described with reference to FIGS. 17A, 17B and 17C. FIGS. 17A, 17B and 17C are perspective views viewed from the vicinity of the developer storage part 4*d* from below in a vertical direction.

First, as illustrated in FIG. 17A, the shaft member 9 is inserted into the developer storage part 4*d* so as to enter the developer storage part 4*d* from the contact part 9*a*. At the time, the contact rib 9*c* is inserted into a vertical groove part 4*d*1 formed at the developer storage part 4*d*. By the engagement of the contact rib 9*c* with the vertical groove part 4*d*1, the shaft member 9 is vertically movable without backlash in the developer storage part 4*d*.

Next, as illustrated in FIG. 17B, the coil spring unit 8 is inserted. Thereafter, as illustrated in FIG. 17C, by adhering the opening seal 5*a* similarly to the comparative example, the displacement part 12 is assembled.

In contrast with the comparative example not provided with the displacement part 12, two components which are the coil spring unit 8 and the shaft member 9 are added in the present embodiment. However, since only two steps of inserting the two components to the developer storage part 4*d* are added to the assembly process, the addition of the assembly process is minimized.

An assembly method will be described in comparison with a prior example (Japanese Patent Application Laid- Open No. 2008-309858). In the prior example, assembly is performed by hooking a reciprocating member acting at a non-rotation part to a crank mechanism provided on a rotatable conveyance member. Therefore, regarding the assembly process of the crank mechanism and the reciprocating member, an assembly direction and the assembly method when performing the assembly are complicated. Thus, in terms of production, it is assumed that the assembly process of the prior example is the process to which huge loads are applied. In the present embodiment, just the two components (the shaft member and the coil spring unit 8) are inserted in the same direction in order so that, compared to the prior example, the assembly is extremely simple and easy in terms of production.

From the above, even when a strong impact is continuously received during physical distribution, the bulk density of the developer in the developer storage part 4*d* rises and the developer is in the aggregated state, the developer replenishing container of the present embodiment can surely and stably discharge the developer. Further, in the present embodiment, the assembly is possible by an extremely simple process in terms of the production, and compatibility with not only a performance but also the production can be also achieved.

<Modification>

The developer replenishing container 1 of the present invention is not limited to the developer replenishing container 1 described in the first embodiment. For example, as a modification, even when the developer replenishing container 1 (not shown in the figure) is not provided with the pump part 3*a* provided in the first embodiment the similar performance can be obtained by providing the displacement part 12. Since a difference between this modification and the first embodiment is just that the pump part 3*a* is not provided, regarding the conveyance of the developer in the developer replenishing container 1, the developer is conveyed to the discharge part 4*c* by the cylinder part 2*k* and the conveyance member 6 similarly to the first embodiment.

Thus, even when the developer replenishing container 1 does not perform the suction process and the exhaust process by the operation of the pump part 3*a*, an effect of surely dissolving the aggregation is obtained for the aggregated developer in the developer storage part 4*d* by the configuration including the displacement part 12 similar to the embodiment described above.

In the configuration not provided with the pump part 3*a*, since the exhaust operation by the pump part 3*a* is not provided, it is desirable to design the caliber of the discharge port 4*a* to be the caliber capable of sufficiently discharging the developer only by the gravity action. Further, by configuring the displacement part 12 similarly to the first embodiment, compared to the prior example, the assembly can be extremely simple and easy even in terms of the production.

Second Embodiment

Figure 21A:
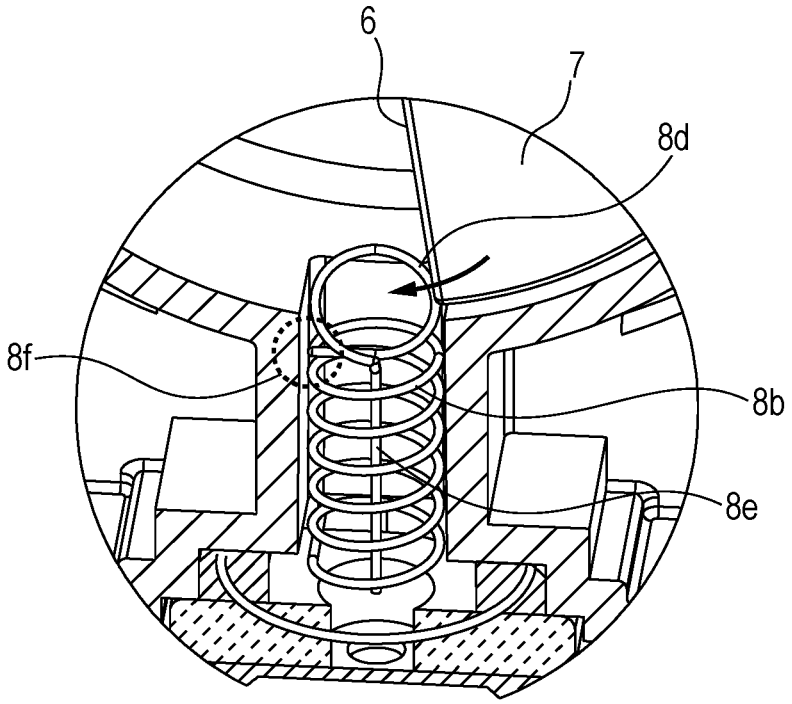
FIG. 21A is a perspective view regarding a contact part in the displacement part.
Figure 21B:
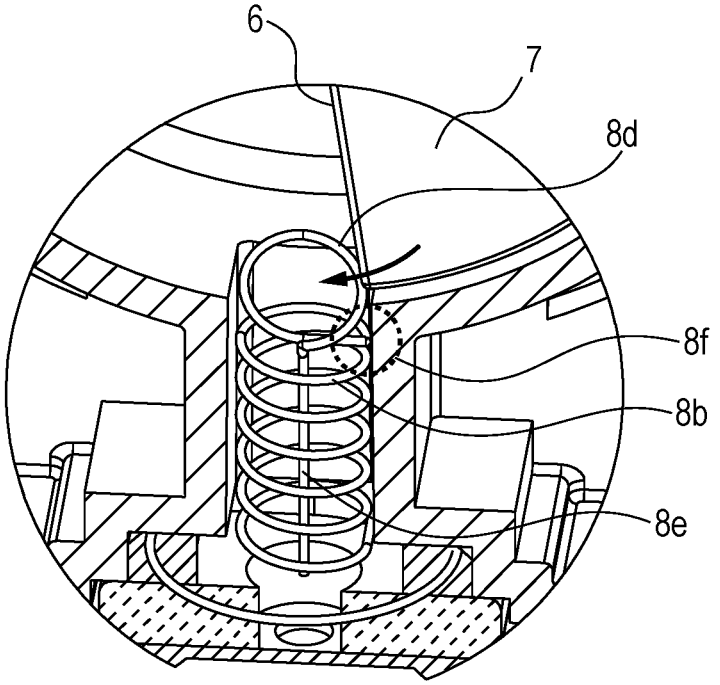
FIG. 21B is a perspective view regarding the contact part in the displacement part.
Figure 22A:
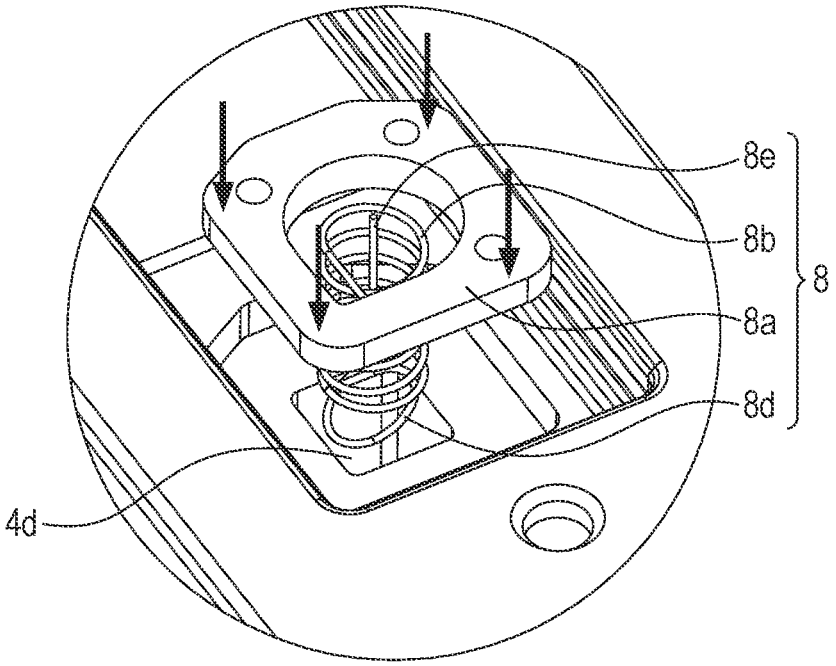
FIG. 22A is a perspective view illustrating an assembly process of the displacement part relating to the second embodiment.
Figure 22B:
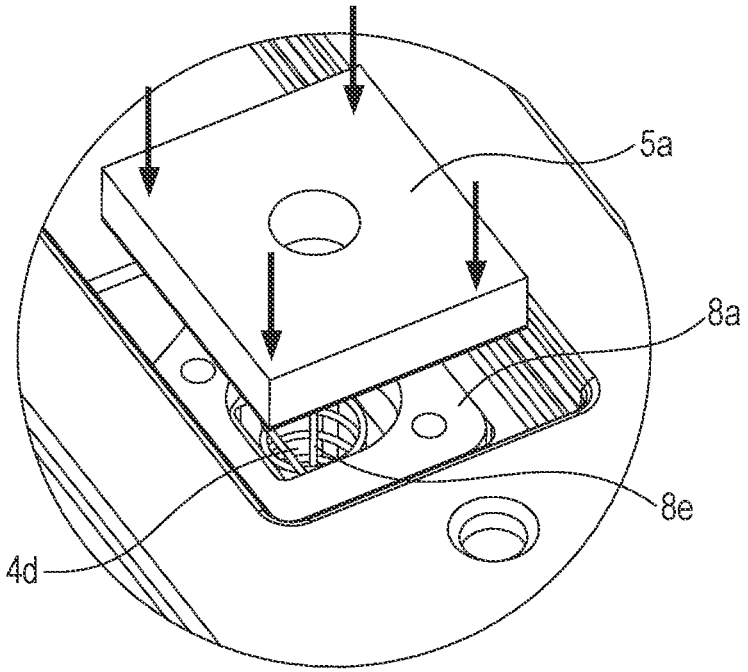
FIG. 22B is a perspective view illustrating an assembly process of the displacement part relating to the second embodiment.

The developer replenishing container according to the second embodiment will be described with reference to FIG. 18 to FIG. 22. FIGS. 18A and 18B and FIGS. 20A and 20B are partial sectional views of the present embodiment and detailed partial sectional views of the vicinity of the developer storage part 4*d*. FIG. 19 is a perspective view of the displacement part 12. FIGS. 21A and 21B are perspective views regarding a contact part 8*d* in the displacement part 12. FIGS. 22A and 22B are perspective views illustrating the assembly process of the displacement part 12.

Figure 18A:
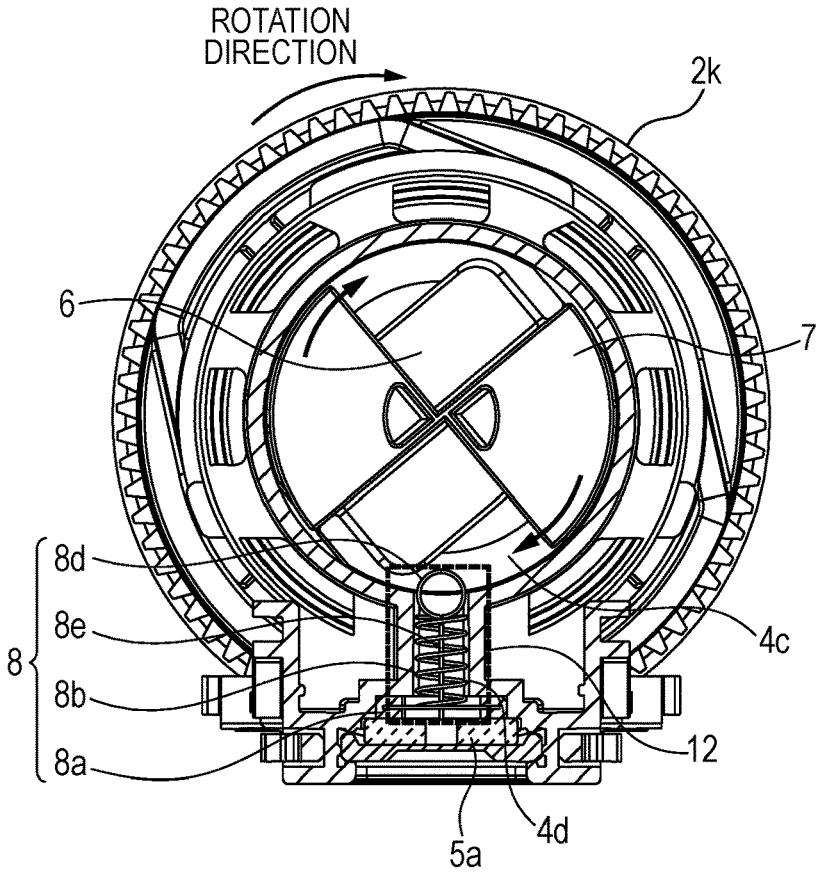
FIG. 18A is a partial sectional view of the developer replenishing container in a second embodiment.
Figure 18B:
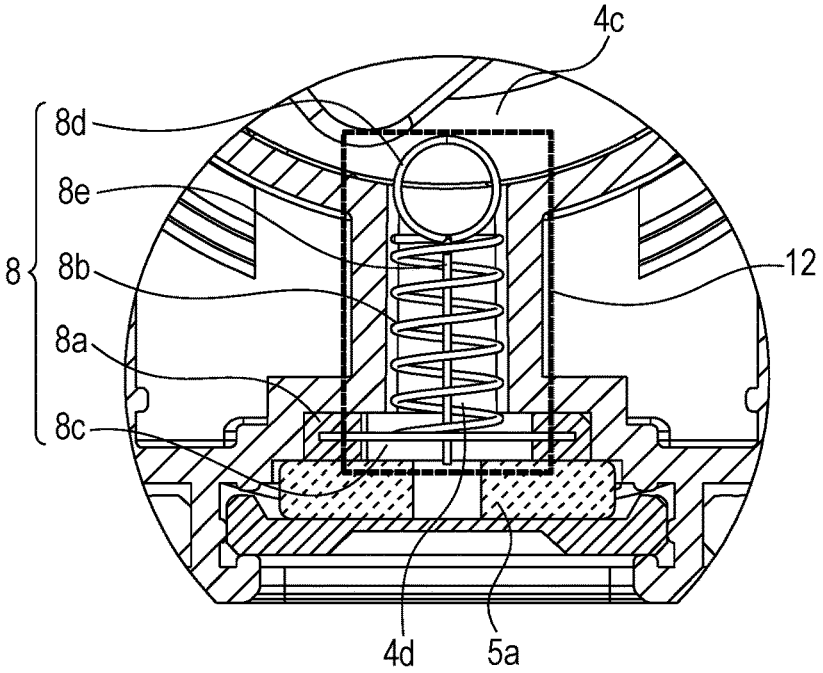
FIG. 18B is a detailed partial sectional view of a vicinity of the developer storage part.
Figure 19:
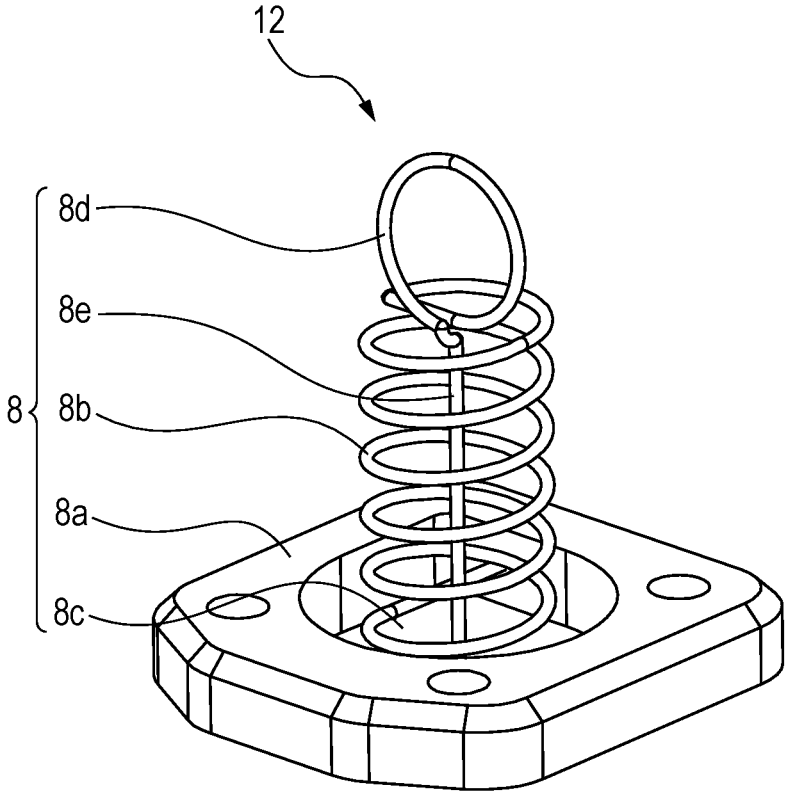
FIG. 19 is a perspective view of the displacement part.

In the present embodiment, as illustrated in FIGS. 18A and 18B, compared to the first embodiment, the configuration of the displacement part 12 in the developer storage part 4*d* is different. The other configurations are the same as the first embodiment. Therefore, the description overlapping with the first embodiment will be omitted, and the configuration of a feature of the present embodiment will be described. In addition, the same characters are affixed to the members having the same functions as that in the above-described embodiment.

Points different from the first embodiment in the present embodiment will be described. In the first embodiment, as illustrated in FIGS. 15A, 15B and 15C, the displacement part 12 provided in the developer storage part 4*d* includes the two components which are the coil spring unit 8 provided with the spring plate 8*a* and the coil spring 8*b*, and the shaft member 9 provided with the contact part 9*a* and the shaft part 9*b*.

In the present embodiment, as illustrated in FIG. 19, the spring plate 8*a* and the coil spring 8*b* of the coil spring unit 8 are provided similarly to the first embodiment. However, differently from the first embodiment, shapes of the contact part 8*d* and a shaft part 8*e* are newly prepared by extending a wire member of the coil spring 8*b*. Also in the present embodiment, the spring plate 8*a*, and the coil spring 8*b*, the contact part 8*d* and the shaft part 8*e* molded with a spring are integrally molded by insertion molding. Thus, the displacement part 12 configured by the two components in the first embodiment are configured by one member in the present embodiment.

Therefore, in the present embodiment, while having the performance of dissolving the aggregation of the developer in the developer storage part 4*d* similarly to the first embodiment, the assemblability is further improved by forming the displacement part 12 with one component.

An operation process of the displacement part 12 according to the present embodiment will be described. FIGS. 18A and 18B illustrate the non-contact state that the contact part 8*d* provided in the displacement part 12 is not in contact with the regulating part 7 of the conveyance member which is rotatable accompanying the rotation of the cylinder part 2*k*.

In FIGS. 18A and 18B, the coil spring 8*b* of the displacement part 12 has the natural length, and the contact part 8*d* prepared by extending the coil spring 8*b* is projected at all times to the inside of the discharge part 4*c* similarly to the first embodiment.

Next, the contact state that the contact part 8*d* of the displacement part 12 is in contact with the conveyance member 6 will be described using FIGS. 20A and 20B.

Figure 20A:
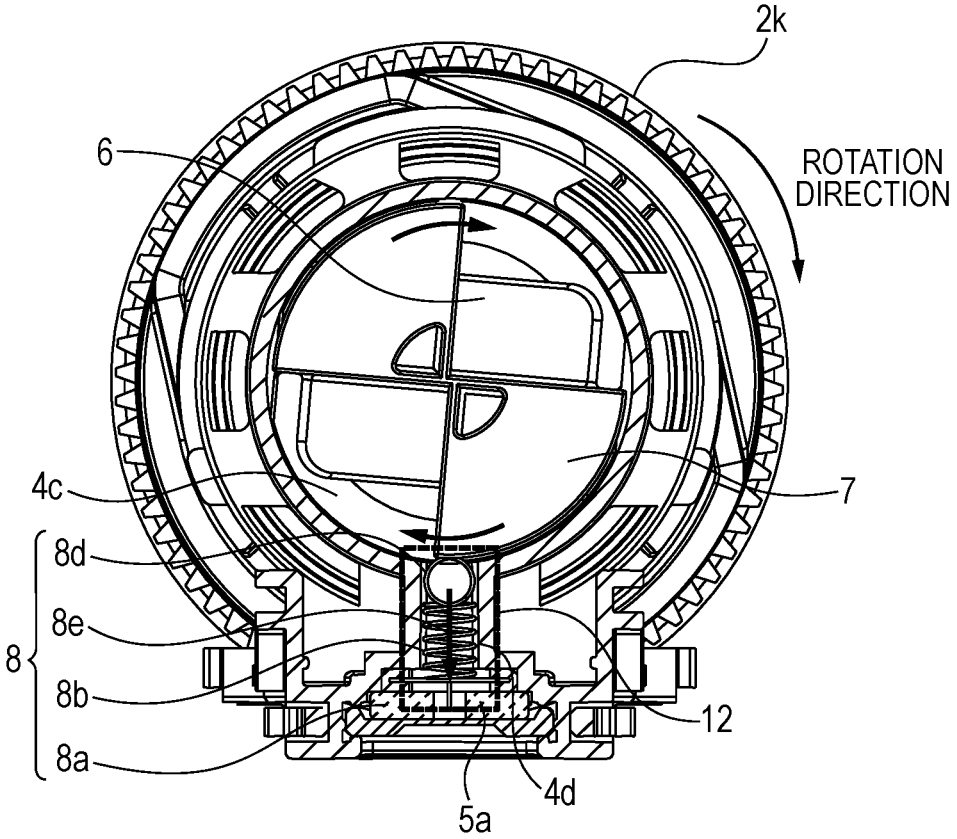
FIG. 20A is a partial sectional view of the developer replenishing container in the second embodiment.
Figure 20B:
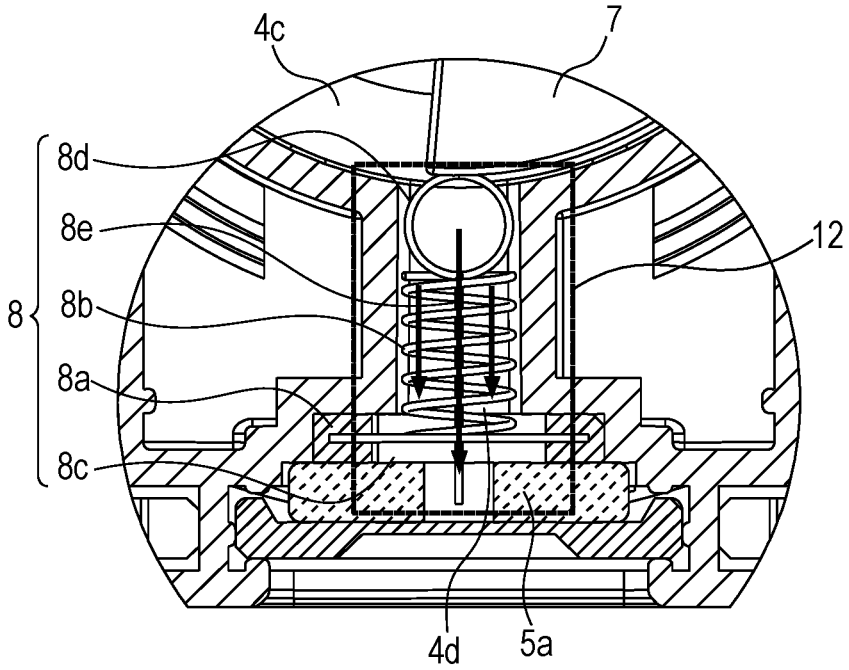
FIG. 20B is a detailed partial sectional view of a vicinity of the developer storage part.

FIGS. 20A and 20B illustrate the state that the conveyance member 6 rotates accompanying the rotation of the cylinder part 2*k* and the contact part 8*d* of the displacement part 12 and the regulating part 7 provided in the conveyance member 6 are brought into contact. In this state, in contrast with the non-contact state illustrated in FIGS. 18A and 18B, the contact part 8*d* is pushed into the developer storage part 4*d*. Accompanying that, the coil spring 8*b* is also pushed vertically downwards and compressed.

By moving the shaft part 8*e* positioned inside the coil spring 8*b* vertically downwards, the lower end of the shaft part 8*e* enters into the opening seal 5*a*. Therefore, by the movement of the displacement part 12 in the contact state, the displacement part 12 can physically act on the developer from the upper part to the lower part in the developer storage part 4*d*.

Thereafter, similarly to the first embodiment, the contact part 8*d* and the conveyance member 6 are changed from the contact state to the non-contact state by the rotation of the conveyance member 6. Thus, the coil spring 8*b*, the contact part 8*d* and the shaft part 8*e* move vertically upwards by the restoration force of the compressed coil spring 8*b*, and return to the non-contact state illustrated in FIGS. 18A and 18B.

As described above, also in the present embodiment, the contact state and the non-contact state of the contact part 8*d* and the conveyance member 6 are repeated by the rotation of the conveyance member 6 accompanying the rotation of the developer replenishing container 1, and the coil spring 8*b*, the contact part 8*d* and the shaft part 8*e* repeatedly reciprocate in vertical upper and lower directions.

As illustrated in FIGS. 18A and 18B and FIGS. 20A and 20B, similarly to the first embodiment, the coil spring 8*b* reciprocates in a vicinity of an inner wall of the developer storage part 4*d* with respect to the developer storage part 4*d*, and the contact part 8*d* formed with a ring spring and the shaft part 8*e* reciprocate in a vicinity of the center of the developer storage part 4*d*. As a result, also in the present embodiment, the displacement part 12 can repeatedly exert the physical action to the entire developer in the developer storage part 4*d* by the reciprocation in the vertical upper and lower directions.

Thus, also in the present embodiment, by adopting the displacement part 12, even in the case that the developer in the developer storage part 4*d* is aggregated, the aggregation can be surely dissolved by the displacement part 12 repeatedly exerting the physical action to the aggregated developer.

In the present embodiment, the contact part 8*d* is formed by an extending portion of the coil spring 8*b*. Here, a winding direction of the coil spring 8*b* when forming the contact part 8*d* will be described.

As illustrated in FIG. 21A, in the present embodiment, a connection part 8*f* of the contact part 8*d* and the coil spring 8*b* is provided on an opposite side to a surface with which the contact part 8*d* is to be actually in contact when the conveyance member 6 rotates. In other words, the connection part 8*f* is provided on a downstream side of the conveyance member 6 in the rotation direction. The object is to prevent deformation of the spring provided on the contact part 8*d* and maintain the sufficient dissolving effect by the displacement part 12 for the aggregated developer.

If the connection part 8*f* is provided on an upstream side of the conveyance member 6 in the rotation direction as illustrated in FIG. 21B, the contact part 8*d* has no part to hold force received in the horizontal direction by contacting with the conveyance member 6, and there is a possibility of deformation when the force is continuously and repeatedly received. If the contact part 8*d* is deformed, the reciprocation in the vertical upper and lower directions of the displacement part 12 is not performed by the contact of the contact part 8*d* and the conveyance member 6, and there is a possibility that the displacement part 12 cannot give a sufficient dissolving effect to the entire aggregated developer in the developer storage part 4*d*.

In the present embodiment illustrated in FIG. 21A, the connection part 8*f* is provided on the downstream side of the conveyance member 6 in the rotation direction, and force received in the horizontal direction by contacting with the conveyance member 6 can be held at the connection part 8*f*, for the contact part 8*d*. That is, the configuration has strength against the deformation of the contact part 8*d*. Thus, regarding the winding direction of the coil spring 8*b* of the contact part 8*d*, as in the present embodiment, the connection part 8*f* of the coil spring 8*b* and the contact part 8*d* can be provided downstream of the conveyance member 6 in the rotation direction.

The pitch of the coil spring 8*b* in the present embodiment is 1.5 mm, the wire diameter is ϕ 0.32, a spring constant is 0.21 N/mm, and the wire diameter of the spring used for the contact part 8*d* and the shaft part 8*e* is ϕ 0.32, however, they are not limited thereto. Similarly to the first embodiment, according to the caliber of the developer storage part 4*d* or the discharge part 4*c* corresponding to the desired replenishing amount, the displacement part 12 can be respectively designed with similar design ideas.

In the present embodiment, with respect to the volume of the developer storage part 4*d* in the comparative example not provided with the displacement part 12 illustrated in FIGS. 14A and 14B, an occupancy rate of the displacement part 12 is about 12%. While the displacement part 12 in the first embodiment has the occupancy rate of 20%, since the contact part 8*d* and the shaft part 8*e* are formed with the spring in the present embodiment, miniaturization of the displacement part 12 is achieved. Thus, regarding the volume of the developer storage part 4*d* in consideration of the occupancy rate of the displacement part 12, the displacement part 12 can be installed without increasing in size of the developer storage part 4*d*. Therefore, contribution can be made also to miniaturization of the developer replenishing container 1.

The assembly process of the displacement part 12 in the present embodiment will be described. In the present embodiment, a point that the displacement part 12 made into one component is added to the developer storage part 4*d* is a process different from the first embodiment.

In the assembly process of the displacement part 12 in the present embodiment, after the integrated displacement part 12 is inserted into the developer storage part 4*d* as illustrated in FIG. 22A, the opening seal is adhered similarly to the comparative example as illustrated in FIG. 22B.

Thus, in contrast with the comparative example not provided with the displacement part 12, one component is newly added in the present embodiment, however, since only one step is added to the assembly process, the addition of the assembly process is minimized. In addition, when comparing to the assembly process in two steps in the first embodiment described using FIGS. 17A, 17B and 17C, since the assembly can be performed in one step and the assembly can be further simple and easy, it is more preferable in terms of the production.

From the above, in the present embodiment, even when a strong impact is continuously received during physical distribution, the bulk density of the developer in the developer storage part 4*d* rises and the developer is in the aggregated state, the developer can be surely and stably discharged regardless of physical distribution influence similarly to the first embodiment. Further, the displacement part 12 in the present embodiment can be assembled by a process further easier than the first embodiment in terms of the production, and compatibility with not only the performance but also the production can be also achieved.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-167526, filed Aug. 27, 2015, which is hereby incorporated by reference herein in its entirety.

What is claimed is:

1. A developer container comprising:

a developer accommodating body capable of accommodating developer;

a discharge body including a discharge opening through which the developer contained in said developer accommodating body is dischargeable;

a gear configured to receive a driving force for rotating said developer accommodating body relative to said discharge body to feed the developer toward said discharge body;

a rotatable member configured to rotate about a rotational axis of said developer accommodating body and including a plurality of rotation portions arranged in a rotational direction of said rotatable member with a space therebetween;

a storing portion disposed on said discharge body, positioned between an end of said developer container and said gear in the rotational direction of said rotatable member and configured to store the developer to be discharged through the discharge opening and to form a communication passageway for fluid-communication between an entrance into which the developer in the inside of said discharge body enters and the discharge opening such that a straight line, which passes through the entrance and the discharge opening, crosses the rotational axis of said rotatable member; and a coil spring provided in the communication passageway and contractable and expandable in a direction of the communication passageway, said coil spring capable of being urged by said rotation portions while said rotatable member rotates, wherein the discharge opening is smaller than an inner diameter of said coil spring.

2. The developer container according to claim 1, wherein each said rotation portion forms a partition wall partitioning an inside of said developer accommodating body.

3. The developer container according to claim 1, wherein said developer accommodating body is rotatable relative to said discharge body.

4. The developer container according to claim 1, wherein said coil spring has a height smaller than that of said storing portion.

5. The developer container according to claim 1, wherein said coil spring is directly contactable to said rotation portions.

* * * * *